US009200447B1

(12) United States Patent
Bargh

(10) Patent No.: US 9,200,447 B1
(45) Date of Patent: Dec. 1, 2015

(54) PRESTRESSED MODULAR FOAM STRUCTURES

(71) Applicant: John H Bargh, Monticello, AR (US)

(72) Inventor: John H Bargh, Monticello, AR (US)

(73) Assignee: Concrete and Foam Structures, LLC, Monticello, AK (US)

( * ) Notice: Subject to any disclaimer, the term of this patent is extended or adjusted under 35 U.S.C. 154(b) by 71 days.

(21) Appl. No.: 14/174,223

(22) Filed: Feb. 6, 2014

Related U.S. Application Data

(60) Provisional application No. 61/762,394, filed on Feb. 8, 2013.

(51) Int. Cl.

| | |
|---|---|
| ***E04B 7/06*** | (2006.01) |
| ***E04B 7/02*** | (2006.01) |
| ***E04C 5/12*** | (2006.01) |
| ***E04C 5/08*** | (2006.01) |

(52) U.S. Cl.
CPC . *E04B 7/06* (2013.01); *E04B 7/026* (2013.01); *E04C 5/08* (2013.01); *E04C 5/12* (2013.01)

(58) Field of Classification Search
CPC ..... E04B 7/06; E04B 7/0226; E04B 2/7425; E04B 2001/2583; E04B 7/026; E04B 2001/3583; E04C 5/12; E04C 5/08
USPC ..... 52/309.4, 309.7–309.9, 309.11, 220.2, 52/220.3, 220.7, 220.8, 782.1, 281, 282.3, 52/79.1, 79.9, 23, 92.1, 93.1, 223.13, 52/223.14, 223.1, 223.7
See application file for complete search history.

(56) References Cited

U.S. PATENT DOCUMENTS

| | | | | |
|---|---|---|---|---|
| 2,874,812 | A | | 2/1959 | Clevett, Jr. |
| 3,000,144 | A | * | 9/1961 | Kitson ..... 52/309.11 |
| 3,054,151 | A | | 9/1962 | Shankland |
| 3,714,747 | A | * | 2/1973 | Curran ..... 52/309.2 |
| 3,778,949 | A | | 12/1973 | Hellerich |
| 3,928,691 | A | | 12/1975 | Knudson |
| 4,157,638 | A | * | 6/1979 | Della-Donna ..... 52/309.9 |
| 4,275,537 | A | | 6/1981 | Pinson |
| 4,545,159 | A | * | 10/1985 | Rizk ..... 52/79.9 |
| 4,567,699 | A | * | 2/1986 | McClellan ..... 52/127.7 |
| 4,580,487 | A | * | 4/1986 | Sosnowski ..... 454/186 |
| 4,599,841 | A | * | 7/1986 | Haid ..... 52/396.04 |
| 4,615,155 | A | | 10/1986 | Chamberlain |
| 4,633,634 | A | | 1/1987 | Nemmer |
| 4,649,682 | A | * | 3/1987 | Barrett, Jr. ..... 174/480 |
| 4,674,250 | A | | 6/1987 | Altizer |
| 4,707,953 | A | * | 11/1987 | Anderson et al. ..... 52/63 |

(Continued)

*Primary Examiner* — Joshua J Michener
*Assistant Examiner* — Alp Akbasli
(74) *Attorney, Agent, or Firm* — Stephen D. Carver

(57) ABSTRACT

A prefabricated, modular enclosure comprising a plurality of plastic foam EPS components forming an integrated structure characterized by energy efficiency and ease of assembly. Wall panels, window panels, door panels, gable panels and roofing panels may be custom configured and glued together, utilizing adaptors on their sides and corner assemblies at intersections. The panels include major and minor channel struts that longitudinally penetrate the panel bodies, snugly lodging within receptive slots. The struts do not contact each other, and no portions of the struts traverses the panel thickness from inside to outside, thus minimizing thermal loss pathways. The wider, major reinforcement struts have offset portions spaced from interior panel surfaces that project interiorly of the enclosure and form a rigid mounting for interior finishing. The chase defined between the modular panels and the interior wall finishing, afforded by the offset struts, may house plumbing, wiring or the like.

11 Claims, 34 Drawing Sheets

(56) References Cited

U.S. PATENT DOCUMENTS

| | | | | | |
|---|---|---|---|---|---|
| 4,716,692 | A | * | 1/1988 | Harper et al. | 52/36.6 |
| 4,731,279 | A | | 3/1988 | Isshiki | |
| 4,759,160 | A | | 7/1988 | Fischer | |
| 4,774,794 | A | * | 10/1988 | Grieb | 52/309.7 |
| 4,813,193 | A | | 3/1989 | Altizer | |
| 4,823,534 | A | | 4/1989 | Hebinck | |
| 4,854,097 | A | | 8/1989 | Haener | |
| 4,924,641 | A | * | 5/1990 | Gibbar, Jr. | 52/204.1 |
| 5,007,222 | A | | 4/1991 | Raymond | |
| 5,097,643 | A | * | 3/1992 | Wittler | 52/238.1 |
| 5,247,773 | A | * | 9/1993 | Weir | 52/592.3 |
| 5,327,699 | A | * | 7/1994 | Khan et al. | 52/93.2 |
| 5,353,562 | A | * | 10/1994 | Decker | 52/309.7 |
| 5,457,926 | A | | 10/1995 | Jensen | |
| 5,497,589 | A | | 3/1996 | Porter | |
| 5,664,386 | A | | 9/1997 | Palmersten | |
| 5,678,384 | A | * | 10/1997 | Maze | 52/783.17 |
| 5,758,463 | A | * | 6/1998 | Mancini, Jr. | 52/309.12 |
| 5,791,090 | A | | 8/1998 | Gitlin | |
| 5,839,249 | A | | 11/1998 | Roberts | |
| 6,006,480 | A | | 12/1999 | Rook | |
| 6,026,629 | A | | 2/2000 | Strickland | |
| 6,082,066 | A | | 7/2000 | Mill | |
| 6,099,768 | A | | 8/2000 | Strickland | |
| 6,101,779 | A | | 8/2000 | Davenport | |
| 6,134,853 | A | | 10/2000 | Haener | |
| 6,151,843 | A | * | 11/2000 | Weaver et al. | 52/92.2 |
| 6,219,973 | B1 | | 4/2001 | Lafferty | |
| 6,240,686 | B1 | | 6/2001 | Mill | |
| 6,331,337 | B1 | | 12/2001 | Osborn | |
| 6,412,243 | B1 | | 7/2002 | Sutelan | |
| 6,418,681 | B1 | | 7/2002 | Dunks | |
| 6,434,900 | B1 | | 8/2002 | Masters | |
| 6,481,165 | B1 | * | 11/2002 | Romary et al. | 52/122.1 |
| 6,519,904 | B1 | | 2/2003 | Phillips | |
| 6,691,485 | B1 | | 2/2004 | Prokofyev | |
| 6,807,787 | B1 | | 10/2004 | Ross | |
| 6,848,228 | B1 | | 2/2005 | Williams | |
| 6,931,803 | B1 | * | 8/2005 | Davis et al. | 52/251 |
| 7,409,801 | B2 | | 8/2008 | Pfeiffer | |
| 7,412,803 | B2 | | 8/2008 | Lehn | |
| 7,412,805 | B2 | | 8/2008 | Parrish | |
| 7,418,803 | B2 | * | 9/2008 | Jenkins et al. | 52/79.7 |
| 7,739,846 | B2 | | 6/2010 | Garrett | |
| 7,797,885 | B2 | | 9/2010 | Mower | |
| 7,861,479 | B2 | | 1/2011 | Crosby | |
| 7,946,092 | B2 | * | 5/2011 | Veerman et al. | 52/741.1 |
| 7,984,594 | B1 | | 7/2011 | Propst | |
| 8,015,772 | B2 | | 9/2011 | Jensen | |
| 8,112,960 | B2 | | 2/2012 | Garrett | |
| 8,127,509 | B2 | | 3/2012 | Propst | |
| 8,136,248 | B2 | | 3/2012 | Beavers, Jr. | |
| 8,381,454 | B1 | * | 2/2013 | Robinson | 52/79.5 |
| 8,479,464 | B2 | * | 7/2013 | Holzworth | 52/284 |
| 8,555,585 | B2 | * | 10/2013 | Dickens | 52/309.9 |
| 8,727,759 | B1 | * | 5/2014 | Wolfe | 425/182 |
| 2002/0170250 | A1 | * | 11/2002 | Chambers | 52/270 |
| 2003/0097806 | A1 | * | 5/2003 | Brown | 52/220.1 |
| 2004/0068948 | A1 | * | 4/2004 | Wrass | 52/309.7 |
| 2004/0107652 | A1 | | 6/2004 | Elliott | |
| 2004/0128776 | A1 | | 7/2004 | Eicher | |
| 2007/0062133 | A1 | * | 3/2007 | Branyan | 52/223.7 |
| 2008/0184649 | A1 | | 8/2008 | Khan | |
| 2008/0229692 | A1 | | 9/2008 | Crosby | |
| 2009/0000211 | A1 | * | 1/2009 | Lozier et al. | 52/23 |
| 2010/0011699 | A1 | * | 1/2010 | Weimer et al. | 52/745.1 |
| 2010/0043315 | A1 | | 2/2010 | Fannon | |
| 2010/0242395 | A1 | | 9/2010 | Garrett | |
| 2010/0263299 | A1 | * | 10/2010 | Ohnishi et al. | 52/79.1 |
| 2010/0269439 | A1 | | 10/2010 | Morrisette | |
| 2010/0293868 | A1 | * | 11/2010 | Holzworth | 52/79.5 |
| 2010/0300012 | A1 | | 12/2010 | Beavers, Jr. | |
| 2011/0165363 | A1 | | 7/2011 | Wolf | |
| 2011/0214374 | A1 | | 9/2011 | Propst | |

* cited by examiner

PRESTRESSED MODULAR FOAM STRUCTURES

CROSS REFERENCE TO RELATED APPLICATION

This utility patent application is based upon, and claims priority from, a previously filed U.S. Provisional Patent Application entitled "Prestressed Modular Foam Structures," Ser. No. 61/762,394, filed in the U.S.P.T.O. Feb. 8, 2013, naming inventor John H. Bargh.

BACKGROUND OF THE INVENTION

I. Field of the Invention

The present invention relates generally to prefabricated, modular structures. More particularly, the present invention relates to dwellings or enclosures that are assembled from modular components substantially comprised of foam plastic, which are fitted together, prestressed and secured upon suitable concrete slabs or foundations to form an enclosure or habitable dwelling, or the like.

II. Description of the Prior Art

It has long been recognized by those skilled in the art that substantial advantages are obtained with modular construction techniques and apparatus. Typically. the construction and assembly of modular homes, for example, involves the shipment of preassembled, modular components to a building site at which a suitable foundation (i.e., a concrete slab) has been preestablished. Modules are designed to be coupled together, and diverse hardware accessories may be employed to securely join the various modules. Typically straps, hooks or cables are provided for securing the component modules to the foundation. Afterward, an inclined or gabled roof is constructed from similar modules or panels, which angularly interconnect with tops of the lower wall panels or modules that are fastened to the foundation.

In some designs the roof is tedious and cumbersome to install. A proper fit must be achieved between the various wall panels, for example, and the roofing elements which contact them. Joints must be contiguous and gap free. Trusses must be properly secured and tensioned. After assembly the integrated structure must be secure and durable, and it must be resistant to environmental forces such as rain, ultraviolet light, snow, ice and high winds. Adequate compensation must be provided for wide temperature shifts as well.

In relatively recent years prefabricated modules have been made of various forms of low density plastic, such as polystyrene or polyurethane foam, or expanded polystyrene foam i.e, EPS foam. Modular plastic construction modules have numerous advantages recognized in the art. Importantly, they are relatively lightweight, so transportation or shipping costs are reduced. Although some modules are bulky, their reduced weight eases the difficulty of manipulation and handling at the job site.

Properly designed plastic foam modules can exhibit favorable insulating characteristics, with minimal leak paths for unwanted heat losses. Thus the R-factor ratings associated with buildings or homes made of such plastic modules are significantly greater than those associated with conventional "stick-built" structures. Another advantage is that molded plastic modules may be relatively easily formed with integral coupling apparatus, such as mortise and tenon joints, or tongue and groove structures, for connecting them to adjacent modules or pieces. Structural integrity is further enhanced by the liberal use of modern adhesives that promote strength and form a dependable seal.

A wide variety of modular construction blocks, including blocks made of polystyrene plastic, exist in the art. For example, U.S. Pat. No. 4,633,634 issued Jan. 6, 1987 discloses a structure utilizing a plurality of expanded, polystyrene panels placed edge-to-edge and secured by connecting studs. Generally C-shaped channels in one panel are fastened in back-to-back relationship with similar channels in mating relationship within grooves of adjacent panels.

U.S. Pat. No. 3,778,949 issued Dec. 18, 1973 discloses synthetic plastic objects secured with reinforcing wires which are embedded in the body. Anchoring means in the form of wire sections extend from the region of the exposed surface to the reinforcing means and are connected therewith.

U.S. Pat. Application No. 20100242395 published Sep. 30, 2010 discloses insulating blocks adapted to be interlocked with other similar blocks to provide form insulating concrete forms for casting concrete.

U.S. Pat. Application No. 20100269439 published Oct. 28, 2010 discloses an insulated wall panel made of polystyrene foam blocks.

U.S. Pat. Application No. 20110165363 published Jul. 7, 2011 discloses panel elements made of plastic foam blocks which are arranged next to one another and connected to form foam bodies.

U.S. Pat. Application No. 20110214374 published Sep. 8, 2011 discloses a building panel utilizing a core with a frame and one or more polystyrene blocks.

Other modular construction blocks and/or building panels or structures are disclosed in U.S. Pat. No. 4,674,250 issued Jun. 23, 1987, U.S. Pat. No. 4,731,279 issued Mar. 15, 1988, U.S. Pat. No. 4,854,097 issued Aug. 8, 1989, U.S. Pat. No. 5,457,926 issued Oct. 17, 1995, U.S. Pat. No. 5,839,249 issued Nov. 24, 1998, U.S. Pat. No. 6,134,853 issued Oct. 24, 2000, U.S. Pat. No. 6,240,686 issued Jun. 5, 2001, U.S. Pat. No. 6,418,681 issued Jul. 16, 2002, U.S. Pat. No. 6,434,900 issued Aug. 20, 2002, U.S. Pat. No. 6,519,904 issued Feb. 18, 2003, U.S. Pat. No. 6,691,485 issued Feb. 17, 2004, U.S. Pat. No. 6,807,787 issued Oct. 26, 2004, U.S. Pat. No. 6,848,228 issued Feb. 1, 2005, U.S. Pat. No. 7,409,801 issued Aug. 12, 2008, U.S. Pat. No. 7,739,846 issued Jun. 22, 2010, U.S. Pat. No. 8,112,960 issued Feb. 14, 2012, and U.S. Pat. No. 8,127, 509 issued Mar. 6, 2012, Of course the art reflects a large number of modular buildings or enclosures that involve interconnected, modular blocks, including plastic blocks and panels. A variety of approaches exist for securing the blocks together, and for attaching panels to the foundation structure.

For example, U.S. Pat. No. 4,615,155 issued Oct. 7, 1986 shows a modular building employing floor, ceiling and roof modules constructed of at least two sheets of rigid, foamed, plastic material such as polyurethane and polystyrene. The sheets are offset laterally with respect to each other, providing a staggered construction. T-shaped plates with portions between the sheets are secured adhesively for reinforcement. The wall modules preferably have the two sheets overlying one another so that all edges of the sheets of the module are aligned and T-plates are secured to these edges. The wall modules may be provided with access openings, such as doors and windows, which are framed by T-plates.

U.S. Pat. No. 5,007,222 issued Apr. 16, 1991 discloses a load-bearing, prefabricated exterior walls and/or panels fabricated of light-weight foam surrounding plastic load-bearing columns. The hollow columns are set onto locking base plates which are mounted on a wood or concrete deck system. The tubular columns are made of a plastic material and are shaped in cross-section in the form of a rectangle, square, diamond, oval or circle. The hollow columns may be used as conduits for electrical wiring, water pipes and in certain cases can be fabricated to act as heat or air-conditioning ducts.

U.S. Pat. No. 5,664,386 issued Sep. 9, 1997 discloses interlocking, modular panels having a foam core with reinforcements. Contiguous panels meet and form a tight seam. During assembly the panels are slidable with respect to one another in a lateral direction.

U.S. Pat. No. 6,331,337 issued Dec. 18, 2001 illustrates the adhesive bonding of side-to-side building blocks to obtain modular sub-assemblies, walls, panels, floors, windows, skylights, etc. Flexible, light-weight, elongated, adhesive tape strips are used to adhesively bond together at least portions of complementary block surfaces.

U.S. Pat. No. 6,412,243 issued Jul. 2, 2002 depicts an ultra-lite, modular composite building system, comprising rigid, solid and expanded matrix materials that produce a functionally homogeneous, composite structure. The rigid material, as the primary structure capable of sustained axial stress, is encapsulated within the body of the matrix material as a sheet or membrane that is bonded to and braced by the matrix material. According to the invention, structures may be either thermoformed or extruded.

U.S. Pat. No. 6,931,803 issued Aug. 23, 2005 discloses a modular building system with a plurality of extruded plastic beams that are stacked and interlocked using a tongue and groove arrangement. Plastic connecting components are provided for interlocking the horizontal beams to a vertical column.

U.S. Pat. No. 7,412,805 issued Aug. 19, 2008 illustrates modular buildings comprising a foundation floor with a plurality of anchors, and a plurality of tracks secured to the floor that support various wall panels. A plurality of securing members passes through the channels or ducts to secure the panels.

U.S. Pat. No. 7,418,803 issued Sep. 2, 2008 discloses a modular home comprising a first section, a second section and a top section that are transported to a slab foundation and then erected on site. The modular home is secured to the slab foundation by a strap arrangement. Once the modular home arrives at the construction site, the home can bolted to the slab, made weather tight, and then connected to the local plumbing and electrical services.

U.S. Pat. No. 7,797,885 issued Sep. 21, 2010 discloses a modular enclosure in the form of a shed or small building comprising a plurality of interlocking panels that may be interconnected to form sidewalls, a roof and/or a floor. The panels may be constructed from blow-molded plastic.

U.S. Pat. No. Application No. 20080184649 published Aug. 7, 2008 discloses a modular enclosure made of interlocking and stackable, molded plastic blocks. Each building block has a tongue on one end and an insertion groove on another end. To form walls and slabs, the blocks are placed adjacent one other in interlocking position by inserting the tongue of the first block into the groove of the adjacent block.

U.S. Pat. No. Application 20100325988 published Dec. 30, 2010 discloses a modular structure for creating a substantially airtight, insulated building.

Other analogous modular and/or prefabricated structures with analogous blocks or panels are depicted in U.S. Pat. No. 4,813,193 issued Mar. 21, 1989, U.S. Pat. No. 4,823,534 issued Apr. 25, 1989, U.S. Pat. No. 4,924,641 issued May 15, 1990, U.S. Pat. No. 5,497,589 issued Mar. 12, 1996, U.S. Pat. No. 6,006,480 issued Dec. 28, 1999, U.S. Pat. No. 6,026,629 issued Feb. 22, 2000, U.S. Pat. No. 6,082,066 issued Jul. 4, 2000, U.S. Pat. No. 6,099,768 issued Aug. 8, 2000, and, U.S. Pat. No. 7,984,594 issued Jul. 26, 2011, U.S. Pat. No. 8,015,772 issued Sep. 13, 2011.

Another pertinent issue facing the designers or installers of modern, plastic block or panel structures involves the technique used for securing the blocks or panels together. The completed structure must be properly secured to the foundation, the composite blocks or panels must be properly secured together, and the resultant structure must be properly reinforced and braced. As mentioned above, straps or cables have been used in the past for anchoring and reinforcing various components. Numerous ancillary hardware items are used to reinforce or anchor plastic panels or blocks, and various forms of junctures are formed between the anchoring or connecting hardware and the blocks or panels.

For example, U.S. Pat. No. 3,778,949 issued Dec. 18, 1973 shows a synthetic plastic item with layers of wires embedded in the body for reinforcement and anchoring. U.S. Pat. No. 3,928,691 issued Dec. 23, 1975 shows reinforcing with ancillary rods. Here polyurethane cores are provided with semicircular grooves that encompass iron or steel reinforcing rods that are captivated and sealed between abutting core members. U.S. Pat. Application No. 20040128776 published Jul. 8, 2004 discloses a tensioning arrangement for building components. An elongated wire cable anchored at its opposite ends in an end piece for absorbing the tensile forces exerted on the cable.

U.S. Pat. Application No. 20100300012 published Dec. 2, 2010 discloses building panels for residential and commercial construction comprising foam blocks connected by adhesive. A plurality of metal supports disposed on opposite sides of the blocks each have an external head portion in contact with the block surface, and an integral stem portion extending into the block. The supports are dimensioned such that the thermal conduction path established by the supports is discontinuous across the insulating block. Straps are commonly used in this for anchoring or strengthening the structure by prestressing components. For example, U.S. Pat. No. Application No. 20040107652 published Jun. 10, 2004 discloses reinforced, foam building components that form energy efficient structures assembled from panels. The structures are anchored to the foundation by straps passing through the panel assemblies. U.S. Pat. No. Application 20080229692 published Sep. 25, 2008 shows insulated, foam panels secured together with various straps.

U.S. Pat. No. Application 20100043315 published Feb. 25, 2010 discloses a network of tensioning straps extending over a framed structure and roof decking and terminating at the foundation. The strap network provides a distributed resistance force throughout the entire structure, enhancing its strength.

Other strap-equipped or prestressed modular systems using straps, brackets or the like are seen in U.S. Pat. No. 4,275,537 issued Jun. 30, 1981, U.S. Pat. No. 5,791,090 issued Aug. 11, 1998, U.S. Pat. No. 6,219,973 issued Apr. 24, 2001, U.S. Pat. No. 7,861,479 issued Jan. 4, 2011, and, U.S. Pat. No. 8,136,248 issued Mar. 20, 2012.

However, despite the above advancements associated with the use of modular foam building blocks or panels, many small, well known imperfections with such materials or components contribute to consumer apprehension and buyer resistance.

For example, plastic foam enclosures must be properly braced and adequately reinforced to satisfy building codes and to provide a safe, wind resistant structure. Of course there are prior art hardware structures, schmuck as those mentioned above, that are designed to brace such systems. However, the structural design of the panels or blocks must accommodate the bracing hardware, so that tensioning of cables, for example, does not break or fracture the panels. The stressing loads imparted by reinforcement cabling generates forces that must be adequately distributed about the structure to prevent damage or deformation. Where cables or straps are used, proper routing and mounting is necessary to insure that cable forces are properly diffused (i.e., distributed over contacted surfaces), so that foam components are not cracked or fractured. This is particularly true near anchoring points, for example, that originate at the concrete foundation, from which cables or straps extend over stacked modules or panels, often traversing roof sections.

Furthermore, maximum practicable structural integrity cannot be achieved with plastic foam panels or blocks alone, despite their inherent strength. Ancillary metal hardware items, such as rails, tracks, beams, channels, wall studs, frame elements and caps are commonly used for reinforcement. These items must be adequately coupled to or routed within the panels or blocks, in a non-destructive fashion. The proper application of load bearing struts or channels that promote tensile strength, for example, must proceed without slowing or unnecessarily complicating the building process. Furthermore, properly installed hardware items must not hinder the enclosure appearance, either inside or outside. Stated another way, the ancillary hardware associated with successful modular designs must be complementary with the plastic foam blocks or panels with which they are used. Each component, whether plastic or metal, must be designed to snugly interfit with, and nondestructively interact with the other. Most importantly, the inherent thermal conductivity of metal reinforcement structures promotes thermal inefficiency or losses, so that such structures must be properly integrated within the foam construction modules to break or minimize loss-inducing, conductive heat paths.

SUMMARY OF THE INVENTION

This invention provides a modular enclosure that comprises a plurality of modular, plastic foam components that form an integrated structure made with interfitted roof, window, door, and roof panels. The modular enclosure may be prefabricated at a remote assembly point, or it may be erected on-site with the interfitting panels.

Preferably the various panels include major and minor vertical reinforcement struts for strength. The struts are pressed into receptive slots defined within the plastic body of the modules. The wider, major reinforcement struts have an offset portion facing interiorly of the resulting enclosure that is spaced from the plastic surface of the panel. The offset strut portions form a rigid mounting for interior walls, accessories or finishing. The chase defined between the modular panels and the interior wall finishing, afforded by the offset struts, may house plumbing, wiring or the like.

The various panel struts extending into the enclosure interior within the panels are isolated from the companion struts on panel exteriors. In other words, there is no conductive thermal path across metal components between inside and outside panel surfaces. As a result, thermal losses are minimized, and a high R-factor results. At the same time, because of the unique pattern of the reinforcement struts, a more secure and stable structure results.

Thus a basic object of the invention is to provide an easily assembled, foam plastic, modular enclosure.

It is also fundamental to the invention to provide modular foam panels and construction parts for building an energy efficient enclosure.

An important related object to provide modular, foam plastic panels and structures exhibiting minimal conduction heat loss.

Another related object is to provide a foam plastic modular enclosure employing panels that are adapted to be finished interiorly and exteriorly with a variety of construction materials including siding, bricks, dry wall and the like.

Another object is to provide a method of constructing a modular enclosure of the character described.

It is also an important object to provide an arrangement for reinforcing foam plastic panels and structures without establishing conduction heat loss paths through the structures.

A related object is to provide a structural bracing or reinforcement system for plastic panels that, in conjunction with interior finishing, establishes chase regions for locating pipes, electrical wiring and accessories, and the like.

Another object is to provide a modular foam plastic enclosure of the character described that is stable and durable, and able to withstand temperature extremes.

It is also an object of the present invention to provide low cost and easily constructible modular housing which is capable of withstanding extreme weather conditions.

Another object of the invention is to provide distributed tension along critical components of a prefabricated, modular structure for nondestructively prestressing it.

Another object of the invention is to provide improved cable stressed, foam plastic modular structures of extreme reliability.

Another object of the invention is to provide a tension system that distributes force evenly about its constituent structural panels.

It is also an important object of the present invention to provide modular panels for prefabricated construction fabricated from lightweight plastic foam that interfit with one another, and which interfit with roof panels overhead.

A related object is to provide prefabricated construction panels having a high strength to weight ratio.

Yet another object of the present invention to provide prefabricated, plastic foam construction panels that exhibit excellent insulating properties.

Another object of the present invention to provide a prefabricated construction wall and building system that may be readily transported and easily assembled on-site.

It is another object of the present invention to provide an energy efficient modular building characterized by a high R-factor.

Still another object of the present invention is to provide a method for fabricating improved modular building components for constructing an energy efficient building.

Another object of the present invention is to provide an outer wall construction for buildings utilizing lightweight, plastic foam panels which are reinforced in a unique manner against loads normally experienced in use.

It is a yet further object of the invention to provide modular foam constructional elements which can be rapidly formed and deployed when constructing a building.

It is a further object of the present invention to provide a self-contained modular home having an integrated, plastic foam roof system.

It is still another object of the present invention to provide a self-contained modular home which can be secured to a permanent foundation and be rapidly connected to water/sewer service and electrical service.

It is yet another object of the present invention to provide a self-contained modular home which can be set onto the foundation without the use of a crane.

Yet another object is to provide a modular building arrangement that may form a variety of structural enclosures, including homes, garages, sheds, storage buildings and the like.

A still further object is to provide modular building methods for assembling and joining adjacent panels that avoids complex joints, leaks, gaps and other common imperfections.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 3A is an enlarged, fragmentary sectional view derived from circled region "3A" in FIG. 3;

DETAILED DESCRIPTION

Figure 1:
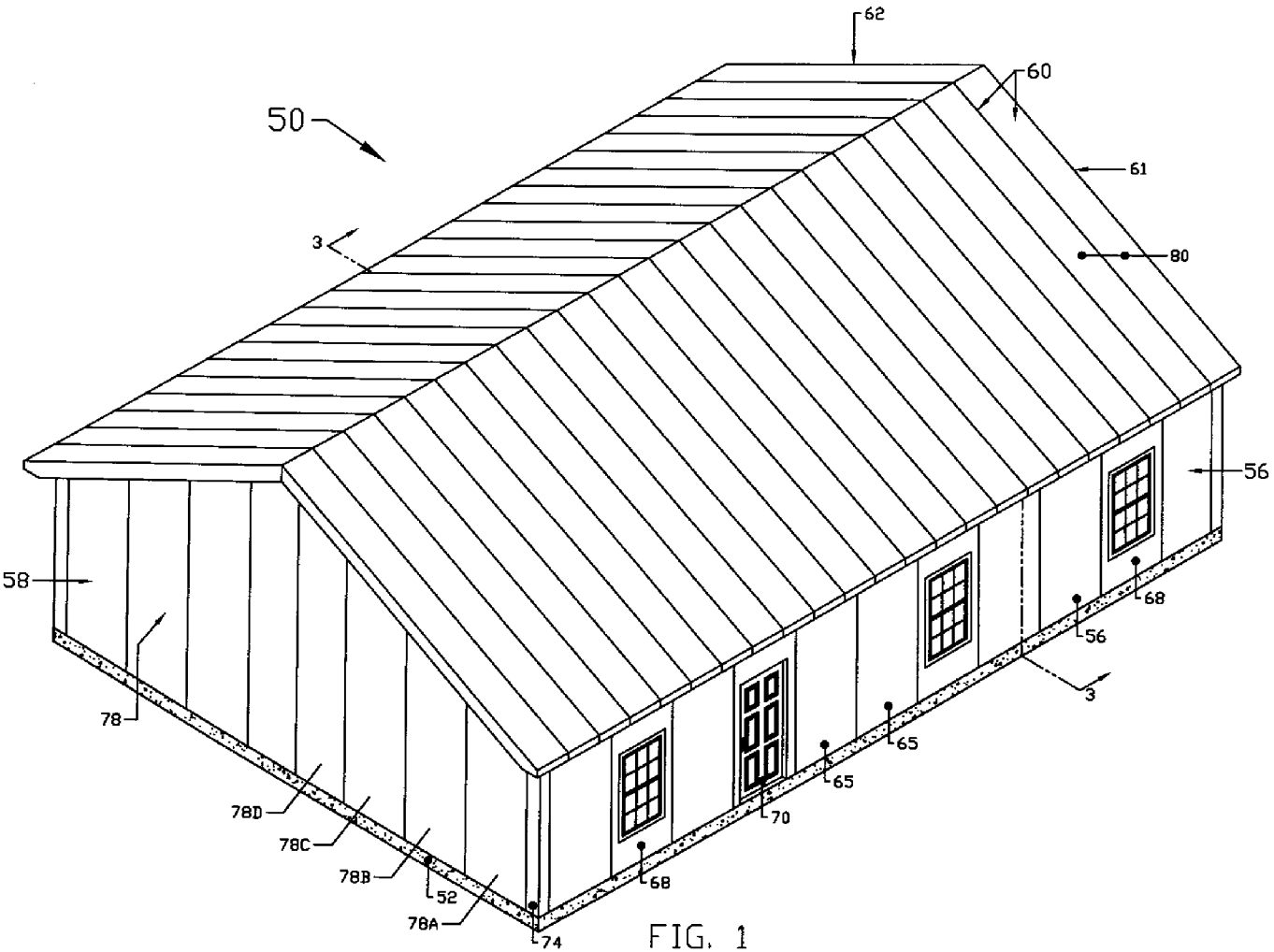
FIG. 1 is an isometric view of a prefabricated, modular enclosure constructed in accordance with the best mode of the invention.
Figure 2:
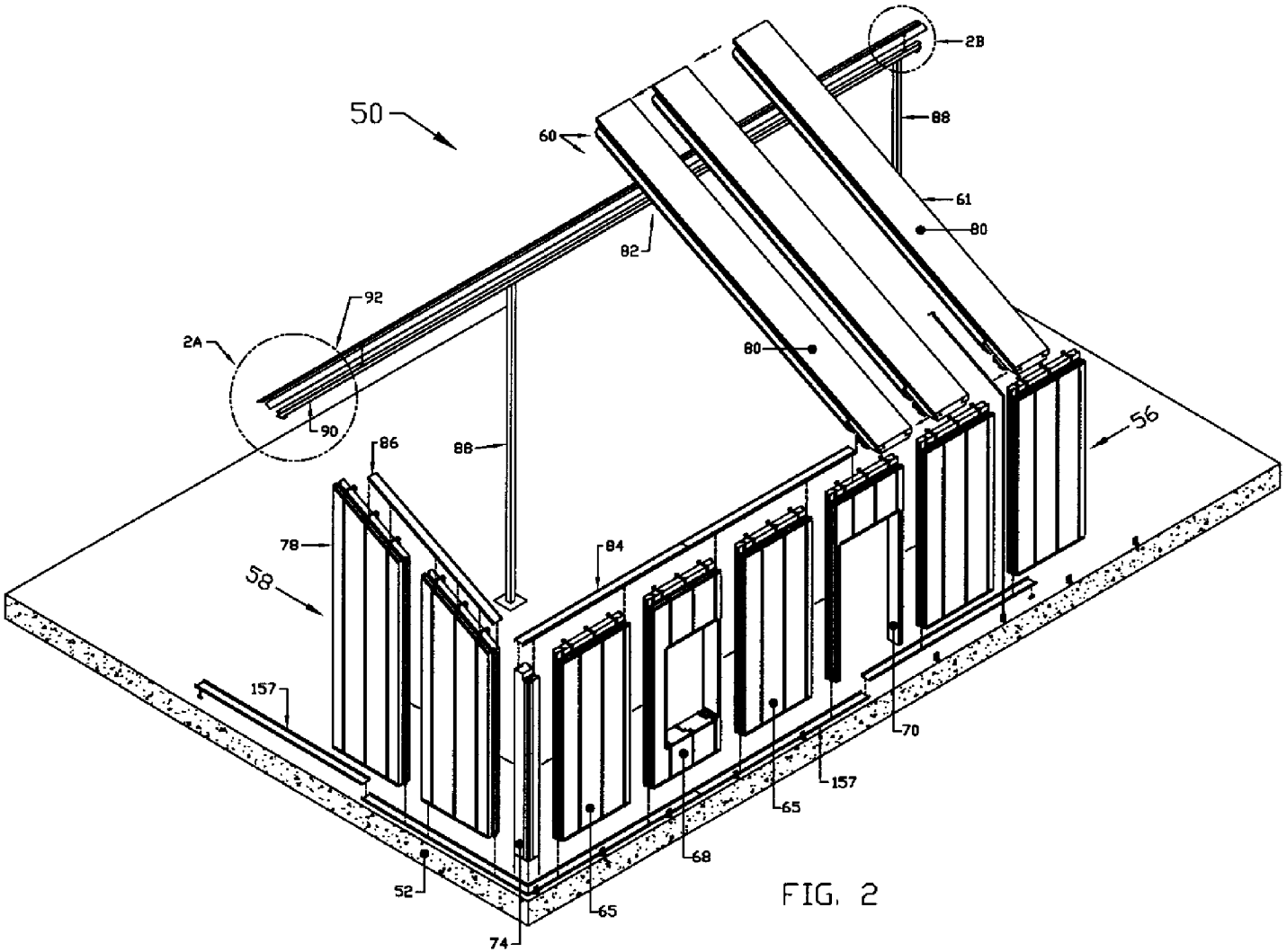
FIG. 2 is a partially exploded, fragmentary, isometric view of the enclosure of FIG. 1, with portions thereof broken away or shown in section for clarity or omitted for brevity.

With initial reference now directed to FIGS. 1 and 2 of the drawings, an upright, energy-efficient, modular enclosure constructed in according to the best mode of the invention, has been generally designated by the reference numeral 50. Enclosure 50 is disposed upon and secured to a suitable supporting surface such as a conventional concrete slab 52. Alternatively the supporting surface may comprise a wooden floor, a pier and beam arrangement, or other horizontal, or elevated substantially rigid, supporting structure. The illustrated enclosure 50 is generally in the form of a house or dwelling, but the panels and modules of the invention may be formed into different building configurations with dissimilar dimensions, sizes and shapes with varying styles and character. Simply by varying the type, size and number of individual panels described below, diverse modules can be assembled at the job site and connected together to form custom walls, roofs, gable structures and the like. Thus, enclosures such as dwellings, barns, warehouses, buildings, retail stores, sheds, storage buildings, garages and other diverse structures with varying dimensions and sizes can be custom made with the components described herein according to the invention. The term "enclosure" as used herein generally designates all of the last mentioned structures.

Enclosure 50 is preferably assembled at the job site upon slab 52 from a plurality of lightweight, blow-molded plastic panels of various forms and sizes that are described hereinafter. In the best mode the molded plastic components are constructed from expanded polystyrene plastic (i.e., "EPS") with ultraviolet (UV) additives or inhibitors, if desired, but other suitable plastics and materials may be used. The plastic must observe fire retardant standards E83 and E84. Preferably boron beads are mixed with the plastic for insect control. The plastic components provide superior resistance to environmental factors, and they provide enhanced durability and strength. Moreover, their thermodynamic characteristics provide highly desirable energy efficiency, resulting in structures exhibiting high R-factors. Preferably a polyurethane adhesive is applied to exposed adjoining surfaces of abutting and interfitted panels described herein and their constituent EPS parts as described below.

The enclosure 50 comprises a pair of spaced apart, elongated and parallel sidewalls 56, (i.e., FIG. 3) and a pair of spaced apart, gabled end walls 58 which together form the bottom of enclosure 50. The end walls are oriented perpendicularly to the sidewalls. The sidewalls comprise multiple sidewall panels of different types described below. An inclined, pitched roof 60 overlapping the sidewalls 56 comprises a pair of similar, inclined, pitched sections 61, 62. The roof 60 and all walls comprise panels with EPS foam bodies constructed and assembled as detailed hereinafter. For example, the each sidewall 56 comprises a plurality of aligned and interconnected, generally rectangular modular wall panels 65 that fit together and are adhesively secured. Sidewall 56 abuts the end wall 58 to form a ninety-degree intersection provided by a corner junction 74 (FIGS. 1, 16, 17) described in detail below. There will be a corner junction 74 joining orthogonally intersecting and abutting walls at each corner of the enclosure 50. End walls 58 comprise a plurality of cooperating, generally rectangular gable panels 78 with inclined tops that increase in height towards the center of the enclosure, and which mate with the underside of the gabled roof 60 and interfit as described in detail below. The modular wall panels 65 can connect with one or more similar modular window panels 68, modular door panels 70, corner junctions 74, and/or modular gable panels 78.

Figure 2B:
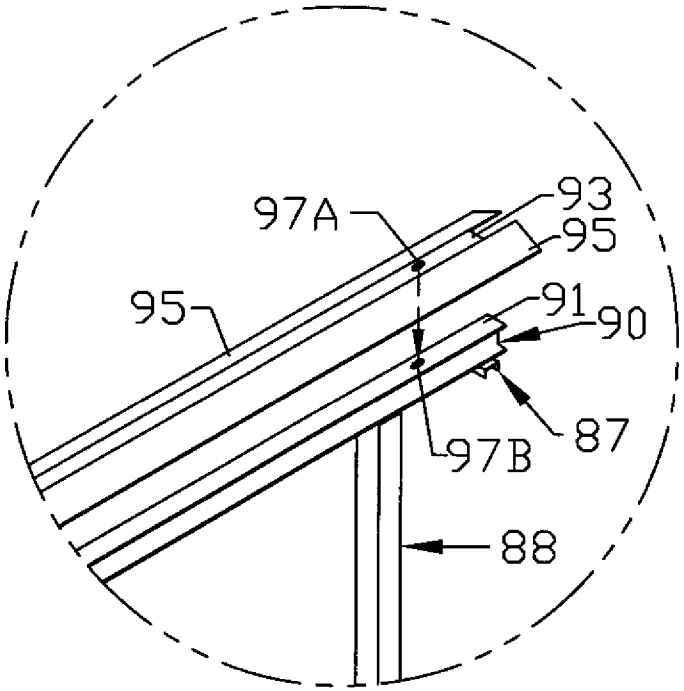
FIG. 2B is an enlarged, fragmentary, isometric view derived from circled region "2B" of FIG. 2, with portions thereof broken away for brevity.
Figure 2A:
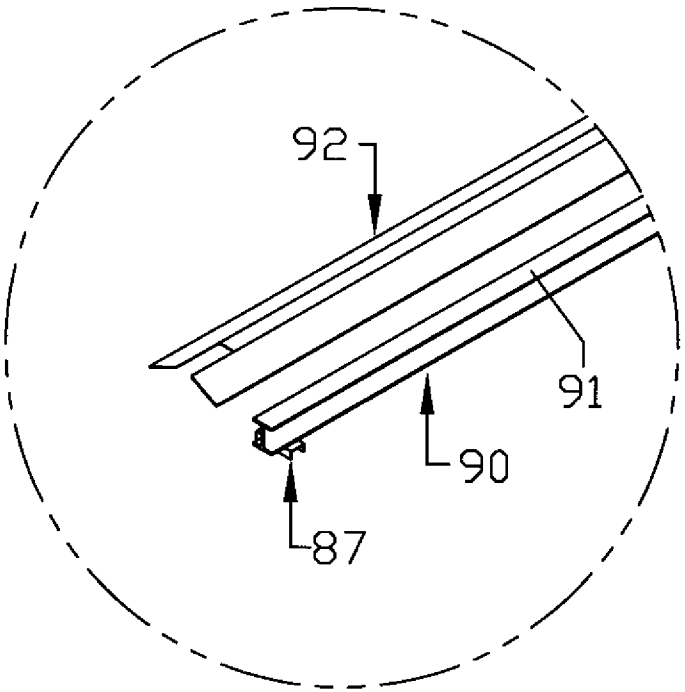
FIG. 2A is an enlarged, fragmentary, isometric view derived from circled region "2A" of FIG. 2, with portions thereof broken away for brevity.
Figure 3:
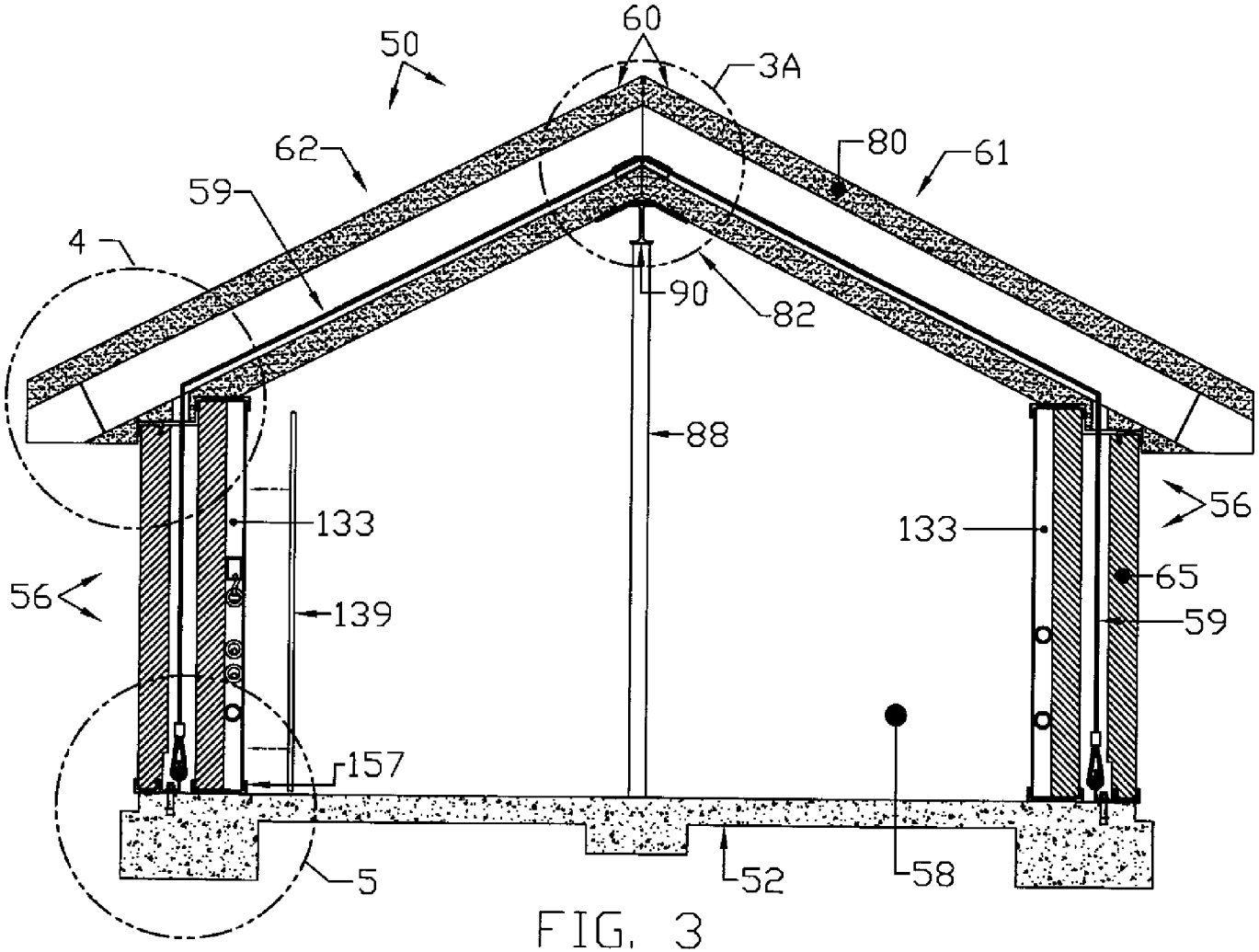
FIG. 3 is an enlarged, sectional view taken generally along line 3-3 of FIG. 1.
Figure 34:
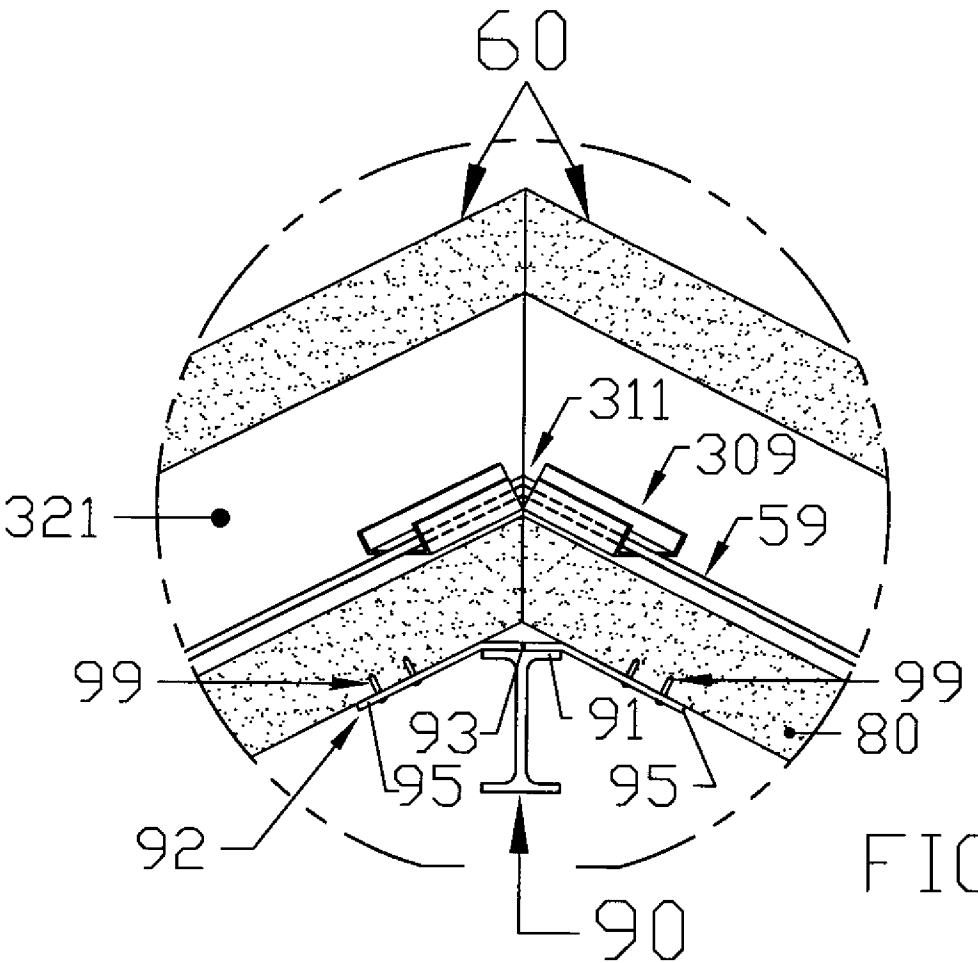

With attention directed to FIGS. 1-3, the gabled roof 60 comprises a plurality of generally rectangular, modular EPS panels 80 that extend angularly, upwardly from the panel tops of each sidewall 56 to the apex region 82 (FIGS. 2, 3) of the roof. Near their bottoms, the roof panels 80 are notched as described later (i.e., FIGS. 4, 32), to rest upon and mate with the stepped sidewalls 56. Preferably the roof 60 is additionally strengthened by at least one central, metallic support column 88 (FIG. 3) normally comprising an I-beam or channel steel piece that extends vertically, upwardly from the concrete slab 52 to the roof apex region 82. Each column 88 couples at its top to an elongated, horizontally oriented, metallic I-beam 90 that extends longitudinally along the top of the enclosure 50 within the enclosure interior apex region 82. Referencing FIGS. 2A and 2B, the vertical support columns 88 are coupled to the underside of the I-beam 90 with a channel-shaped receptor 87, several of which may be spaced apart along the underside of I-beam 90 as desired.

Figure 3B:
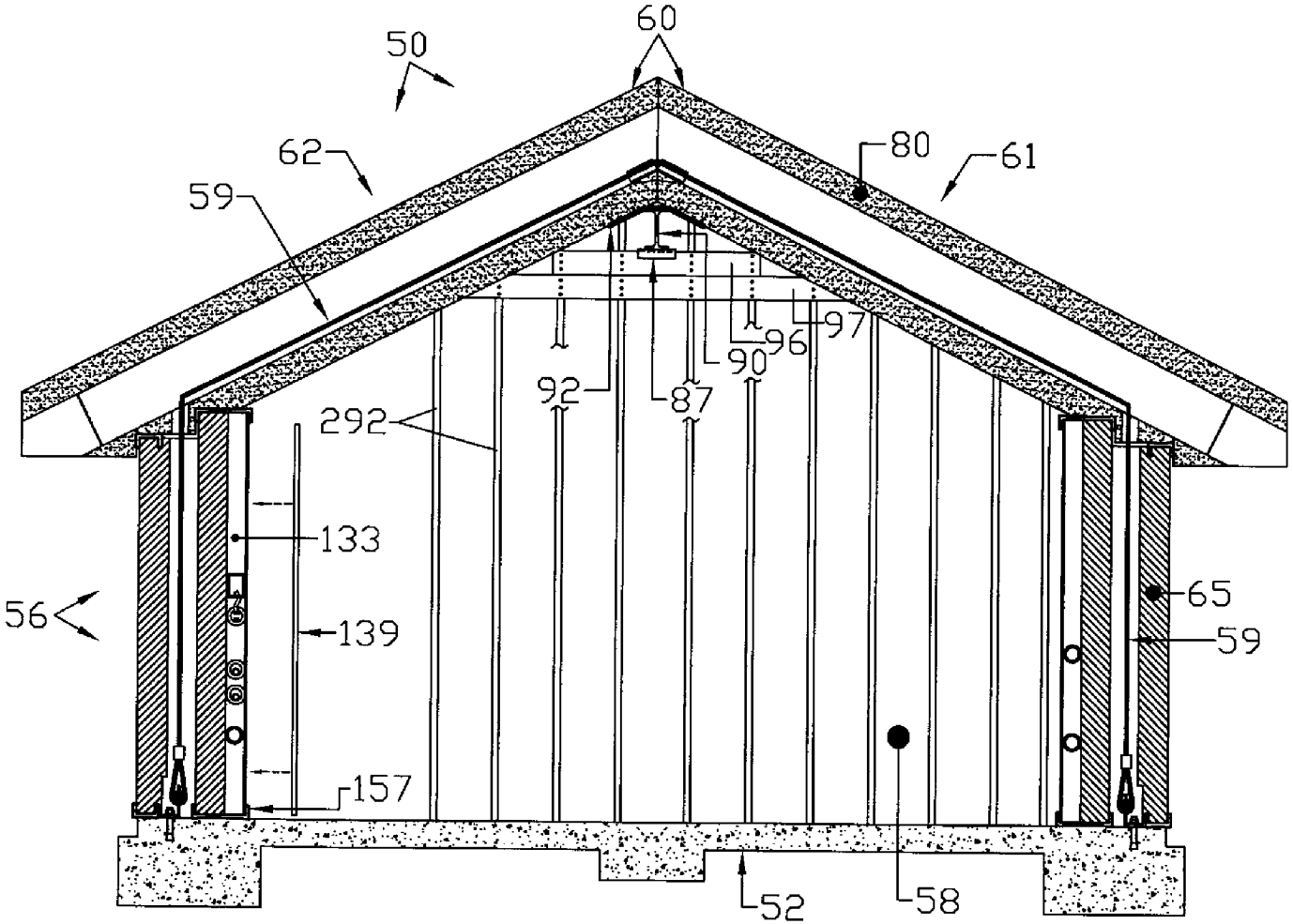
FIG. 3B is an enlarged, fragmentary, sectional view taken generally along line 3-3 of FIG. 1 which is similar to FIG. 3, but with portions of the rear gable end wall omitted to reveal the preferred metal wall studs.

The top flange portion 91 of the I-beam 90 contacts and elevates an elongated, horizontally oriented gusset 92 that extends horizontally through the apex region 82 (FIG. 3) across the entire, interior length of the enclosure 50, parallel with the longitudinal axis thereof. The supportive gusset 92 preferably comprises a flat, center portion 93 (i.e., FIGS. 2A, 2B, and 3A) which is integral with a pair of spaced-apart and inclined wings 95 that abut opposite, inclined surfaces of the roof panels 80. The purpose of the gusset 92 is to spread out the forces or pressure exerted by the supported roof 60. The top flange 91 (FIG. 2B) of the I-beam 90 is attached to the center portion 93 of the supporting gusset 92 with suitable fasteners that penetrate aligned orifices 97A and 97B (FIG. 2B). The gusset wings 95 (FIG. 3A) are secured to the roof panels 80 by fasteners 99 (FIG. 3A). The somewhat triangular cross section of the gusset 92 enables it to flushly mount within the apex region 82 below the roof 60. Of course the elongated gusset 92 may be assembled from a plurality of axially aligned sections that are suitably affixed together. Preferably a polyurethane adhesive is applied to the exposed upper surfaces of support wings 95 to bond with the roof. Importantly, the transverse channel supports 87 (i.e., FIGS. 2B, 3B) that support horizontal I-beam 90 in regions close to the end walls are attached to upper cross braces 96 and 97 (FIG. 3B) to distribute the loading forces. These cross braces 96, 97 are fastened to the inner, major reinforcement struts 292 of the gable end wall 58; as discussed later, these struts 292 reinforce the gable wall panels that form end walls 58.

Figure 4:
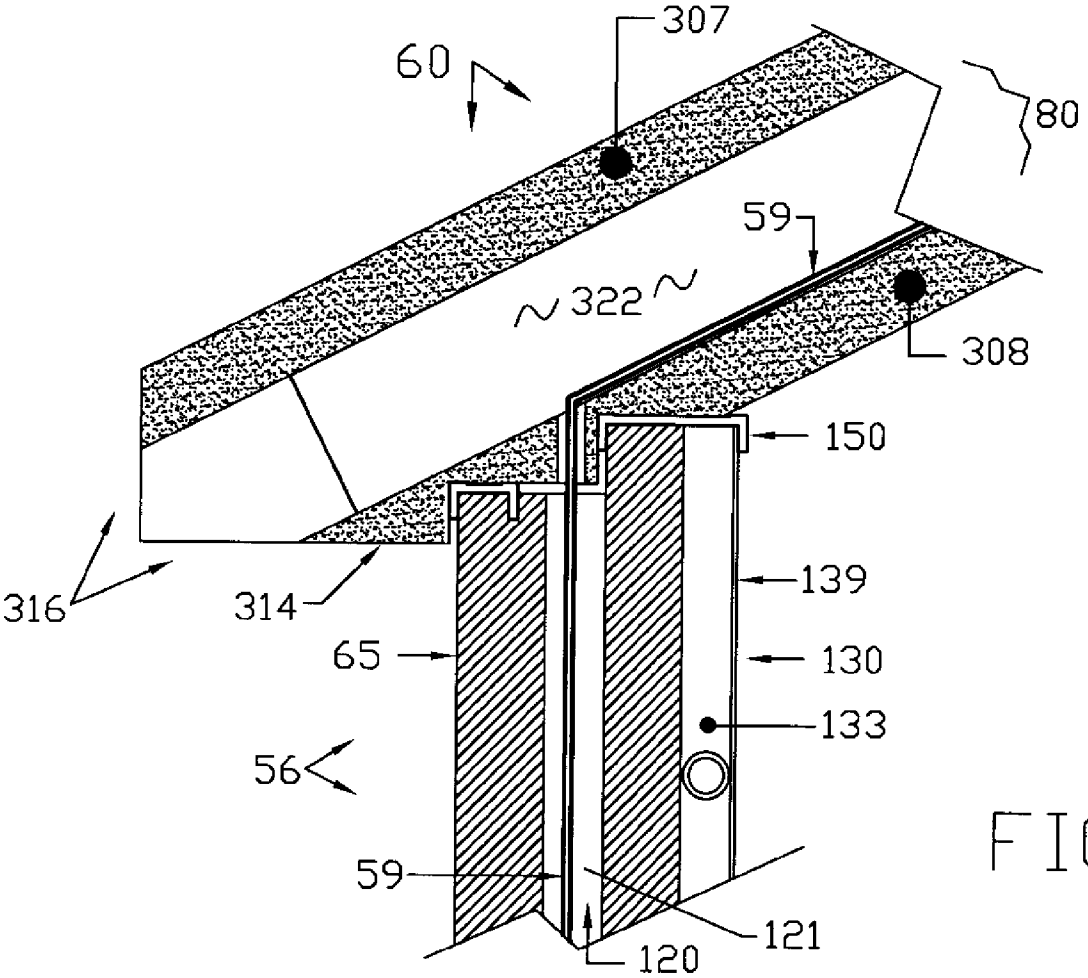
FIG. 4 is an enlarged, fragmentary sectional view derived from circled region "4" in FIG. 3.
Figure 7:
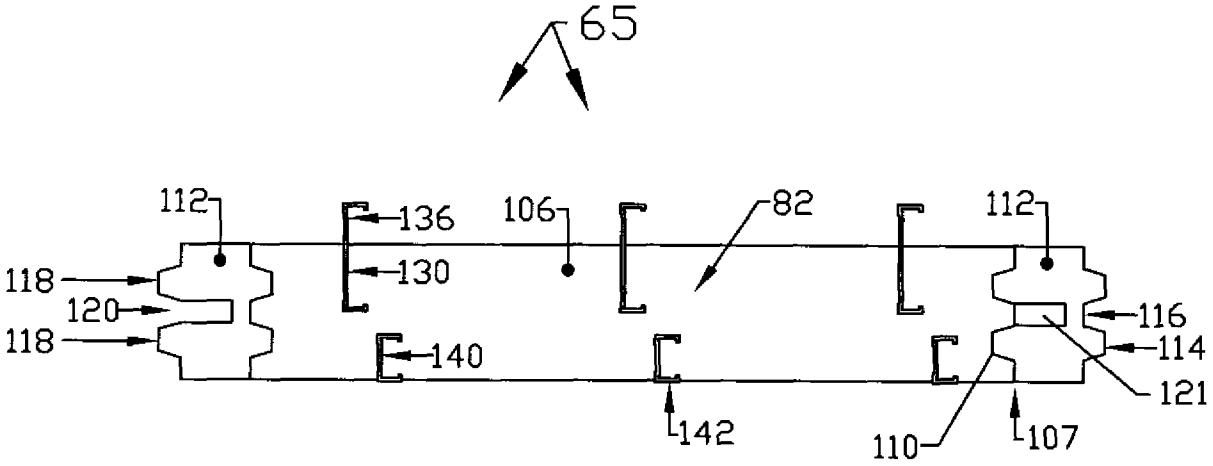
FIG. 7 is an enlarged, top plan view of the preferred wall panel and the preferred panel end adaptor as viewed from lines 7-7 of FIG. 6.
Figure 8:
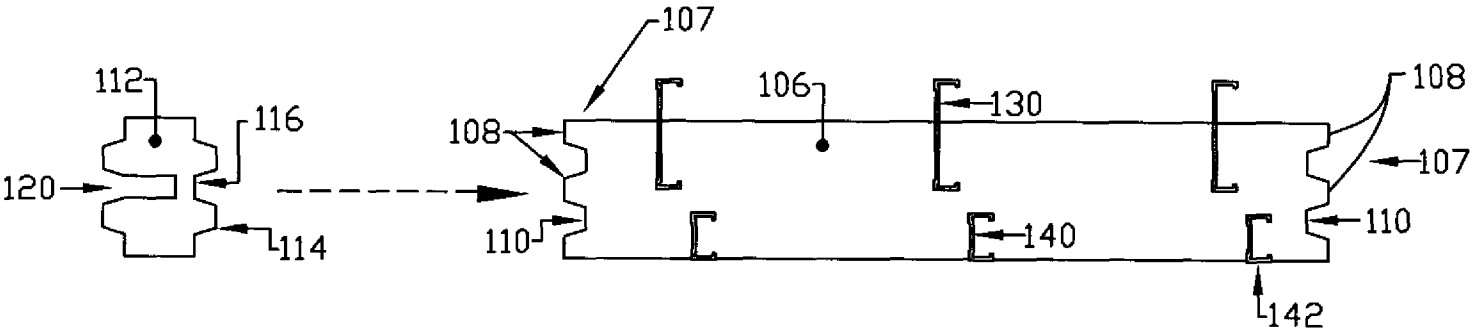
FIG. 8 is an enlarged, partially exploded, top plan view of the preferred wall panel structure similar to FIG. 7, but with the panel end adaptor spaced away from the wall panel.
Figure 10:
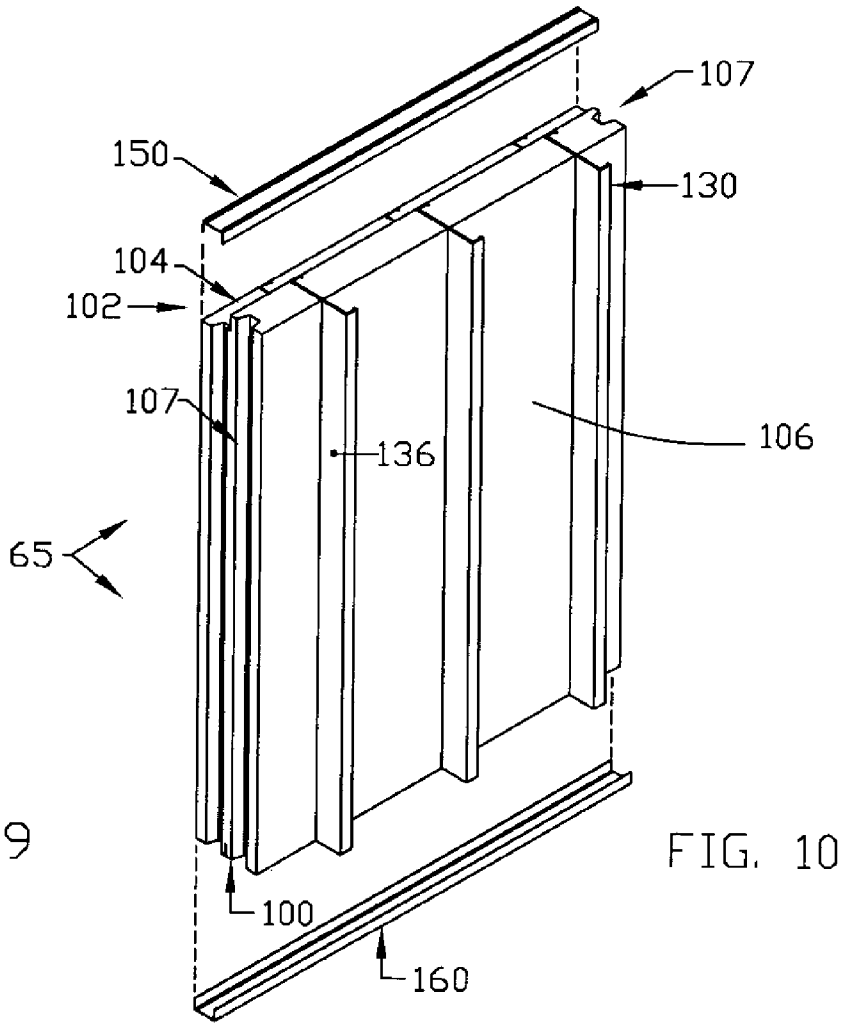
FIG. 10 is a partially exploded, frontal isometric view of the preferred wall panel seen in FIGS. 6-9, with the insides surface facing the viewer.
Figure 9:
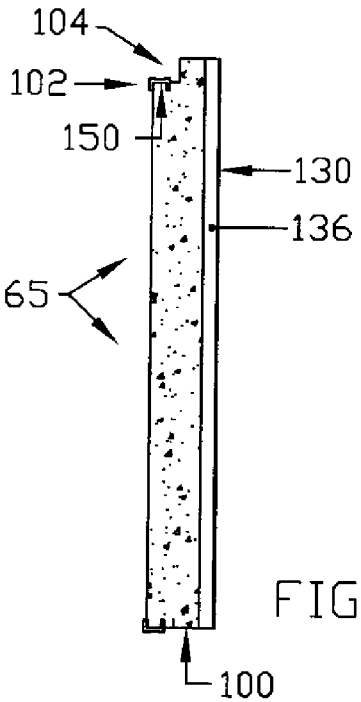
FIG. 9 is a longitudinal sectional view of the preferred wall panel taken generally along line 9-9 of FIG. 6.
Figure 11:
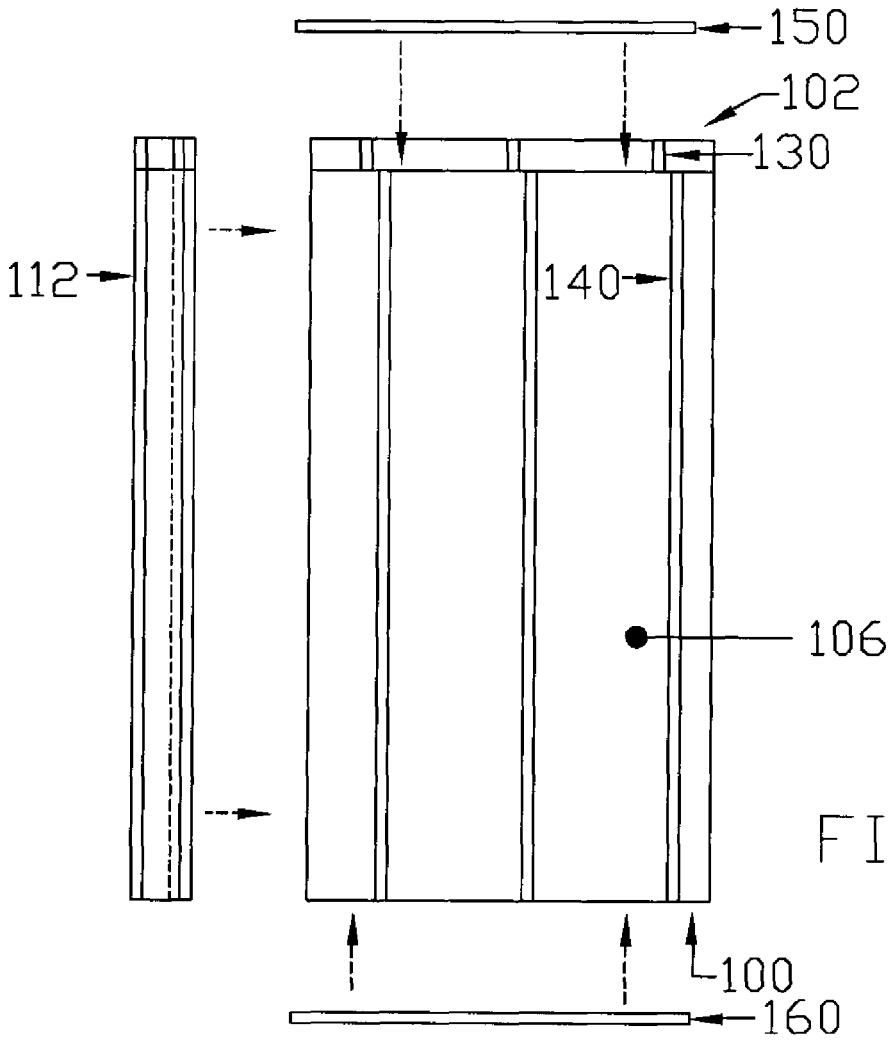
FIG. 11 is an enlarged, partially exploded, rear plan view of the preferred wall panel and the preferred end panel adaptor of FIGS. 6-10.

With primary reference directed now to FIGS. 6-15, the generally rectangular, modular wall panels 65 comprise a plurality of interfitted EPS plastic parts and metal 2 reinforcement accessories. As seen in FIGS. 9 and 10, the modular wall panels 65 preferably have a flat bottom 100, and a spaced apart, notched top 102 (i.e., FIGS. 10, 15) in which notched region 104 (FIG. 10) provides an elongated, upper shoulder that faces towards the outside of the enclosure 50. This stepped configuration provides advantages in mounting the various channel reinforcements discussed below, and it presents an advantage in coupling the roof 60 over the tops of the sidewalls, as seen in FIG. 4 and elsewhere and discussed thoroughly later.

Each modular wall panel 65 (i.e., FIGS. 6, 10) comprises a generally rectangular, main EPS body 106 whose opposite ends 107 (FIGS. 7, 8) include integral tongues 108 and grooves 110. In the best mode, pairs of wall panel bodies 106 comprise identical tongue and groove couplings at their ends 107 and thus cannot connect with one another. For this reason, each wall panel body 106 connects to other panels with the aid of adaptor means. A panel body 106 is thus glued to, at least at one end 107, to an elongated, complementary, adaptor 112 (i.e., FIGS. 8, 11) as indicated by arrows in FIG. 11. Adaptor 112 functions not only as an adaptor for coupling panels together, but as a spacer which, in effect, widens the panels. This has been found desirable at present because suitably sized EPS billets from which EPS bodies 106, for example, are cut, are not available. However, the adaptor 112 could be formed integrally with the various wall panels (or door and/or window panels described hereinafter) if suitably sized bulk EPS blanks were available.

Figure 5:
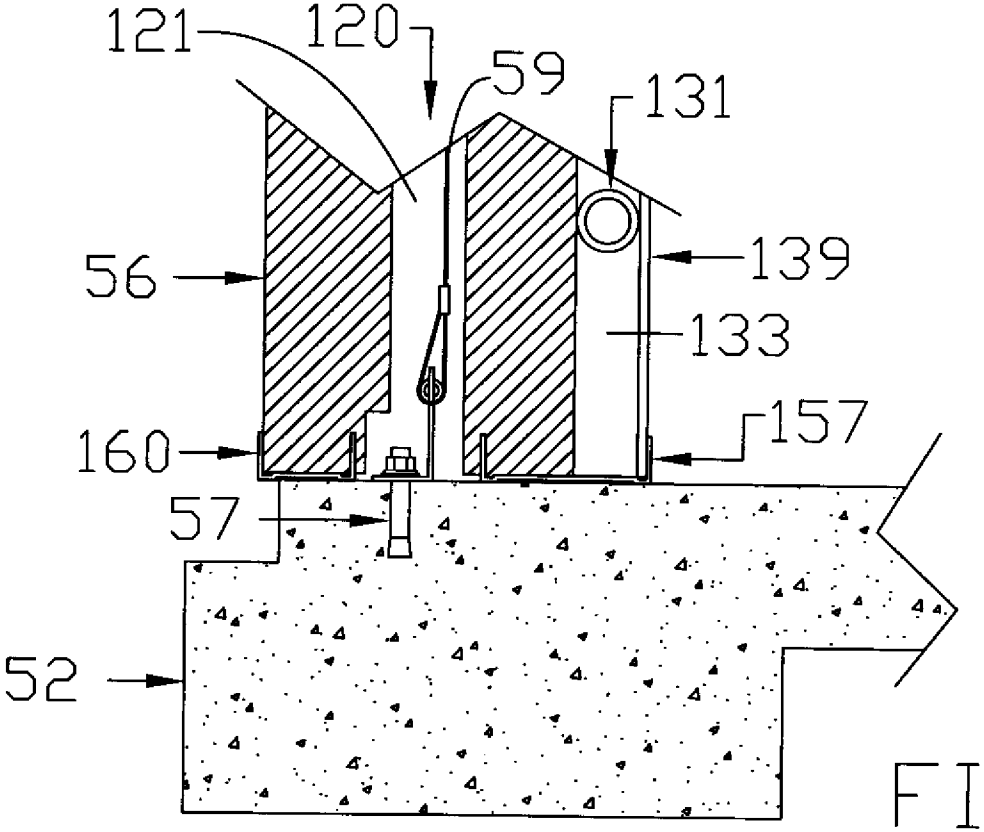
FIG. 5 is an enlarged, fragmentary sectional view derived from circled region "5" in FIG. 3.
Figure 6:
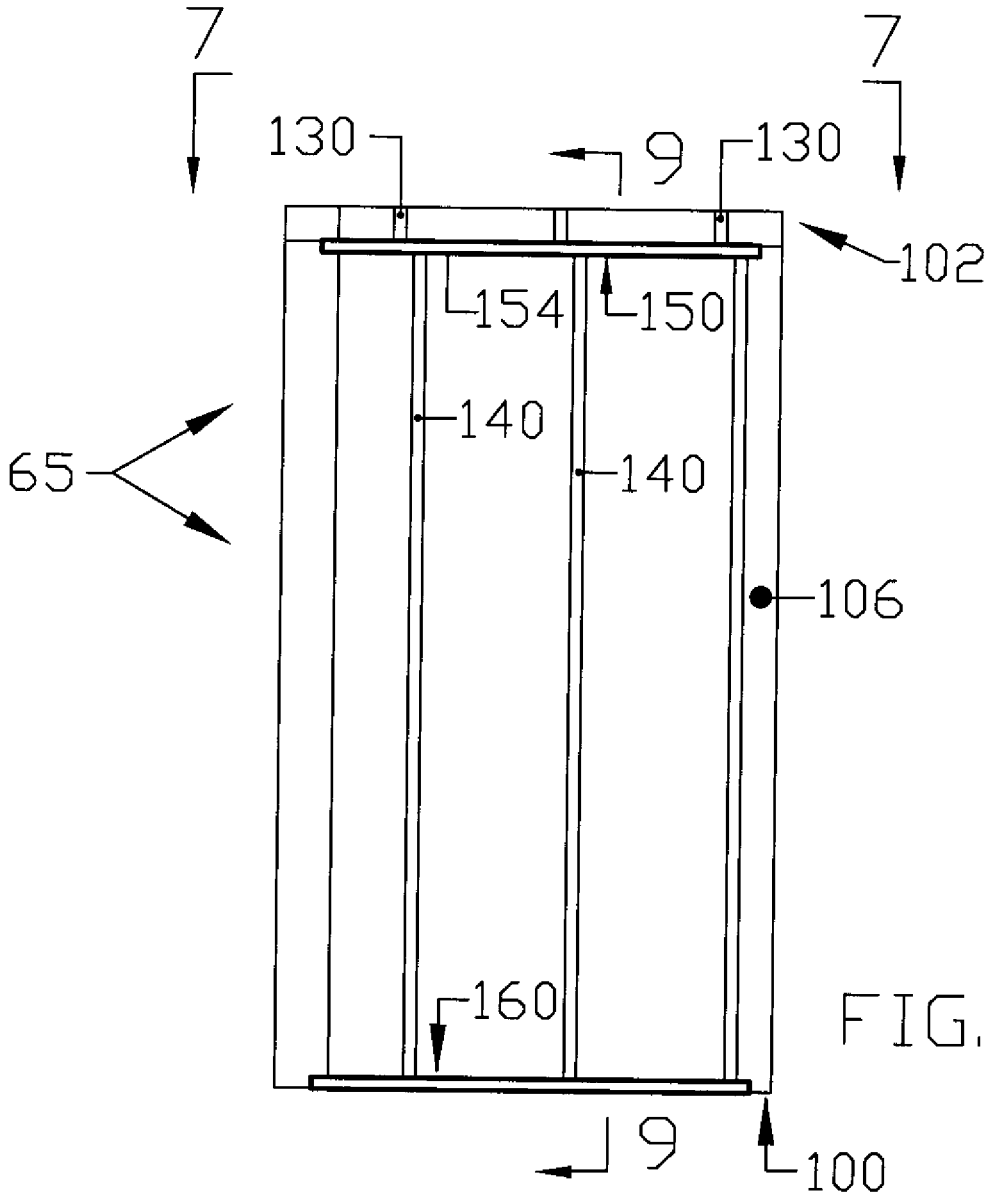
FIG. 6 is an enlarged, rear plan view of a preferred wall panel that is illustrated coupled to a preferred panel end adaptor.

Each adaptor 112 has tongues 114 and grooves 116 that form a complementary fit with the tongues and grooves 108, 110 respectively in the ends of body portion 106. With a panel adaptor 112 glued in place as seen at both ends of FIG. 7, the opposite sides of adaptor 112 may be fitted to other modular panels, or to the elongated, EPS corner junction 74 (FIGS. 13, 16, 17) discussed below. To form a completed wall, multiple wall panels 65 are glued and fitted together as in FIG. 14, through the use of multiple panel end adaptors 112. At the left of FIG. 7 it is seen that the adaptors mate and nest flushly with the wall panel tongue and groove structure. However, viewing the right side of FIG. 7, it is seen that the middle tongue 108 of the wall panels do not seat completely within a routing groove 120 in 22 the adaptors, resulting in a routing void 121 (FIG. 7) within the post-assembly, unoccupied volume of the adaptor groove 120 (FIGS. 7, 8). Strapping 59 (i.e., FIG. 5) is routed through the routing grooves 120 and routing void 121 as depicted in FIG. 5 and discussed below in detail.

Figure 14:
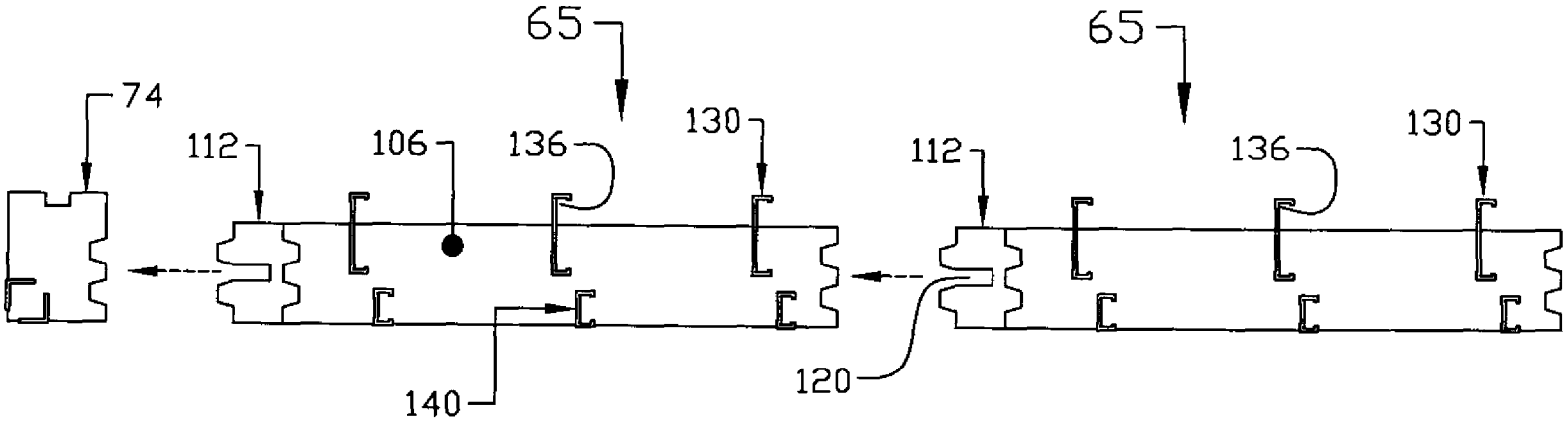
FIG. 14 is an enlarged top plan view taken generally along line 14-14 of FIG. 13.
Figure 17:
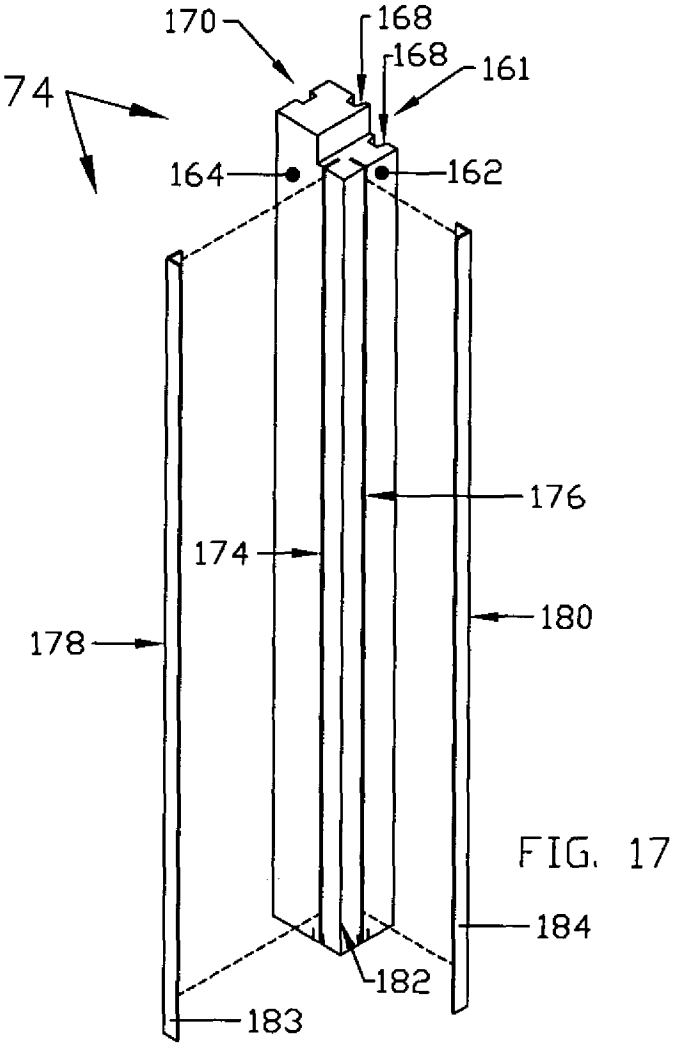
FIG. 17 is a partially exploded, rear isometric view of the preferred corner junction of FIG. 16.
Figure 16:
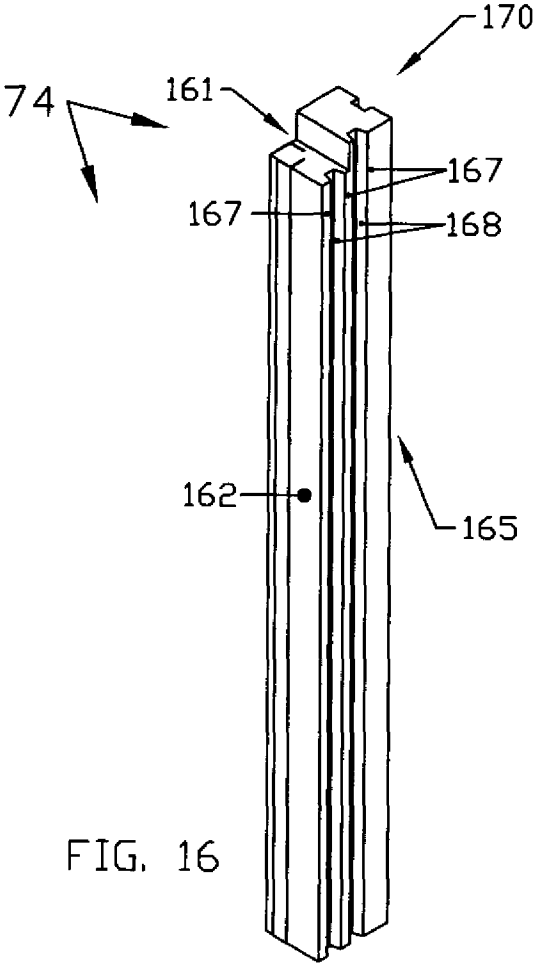
FIG. 16 is a frontal isometric view of a preferred corner junction.

Coupled wall panels 65 (FIG. 14) form an assembled wall that terminates at a corner (i.e., at the left of FIG. 14) which is occupied and defined by a reinforced, EPS corner junction 74 (FIGS. 14, 16, 17). Each corner junction has a tongue and groove junction for assembly to other panels, such as the window or door or gable panels discussed below, by coupling to the adaptors 112 (i.e., FIG. 14) discussed earlier. As explained later, the enclosure 50 is strengthened by prestressing straps 59 (i.e., FIGS. 3,5) discussed later, that can be routed within and through the deep grooves 120 in the adaptors 112.

For strength and reinforcement, each wall panel 65 is fitted with a plurality of elongated, channel reinforcement struts that are press-fitted into or through predefined slots in the EPS body structure. There are several vertical struts and horizontal struts for each wall panel and for most other panels. The preferred vertical struts in each panel comprise three major, channel steel reinforcement struts, and three complementary, minor channel steel reinforcement struts, all of which are parallel with one another and spaced apart on opposite surfaces of the panel. No major struts touch or contact any minor struts to prevent heat loss pathways. Further, no reinforcement struts extend through any panel between the front and rear surfaces. In the best mode, each panel preferably comprises two horizontal reinforcement struts as well. The predefined slots are slightly wider than the thickness of the channel reinforcements that snugly fit within them. When the reinforcement struts are inserted, the adhesive eventually expands to fill all voids. For proper reinforcement strut engagement within the receptive panel slots, it is preferred that H. B. Fuller type UR-218 adhesive be used.

Figure 12:
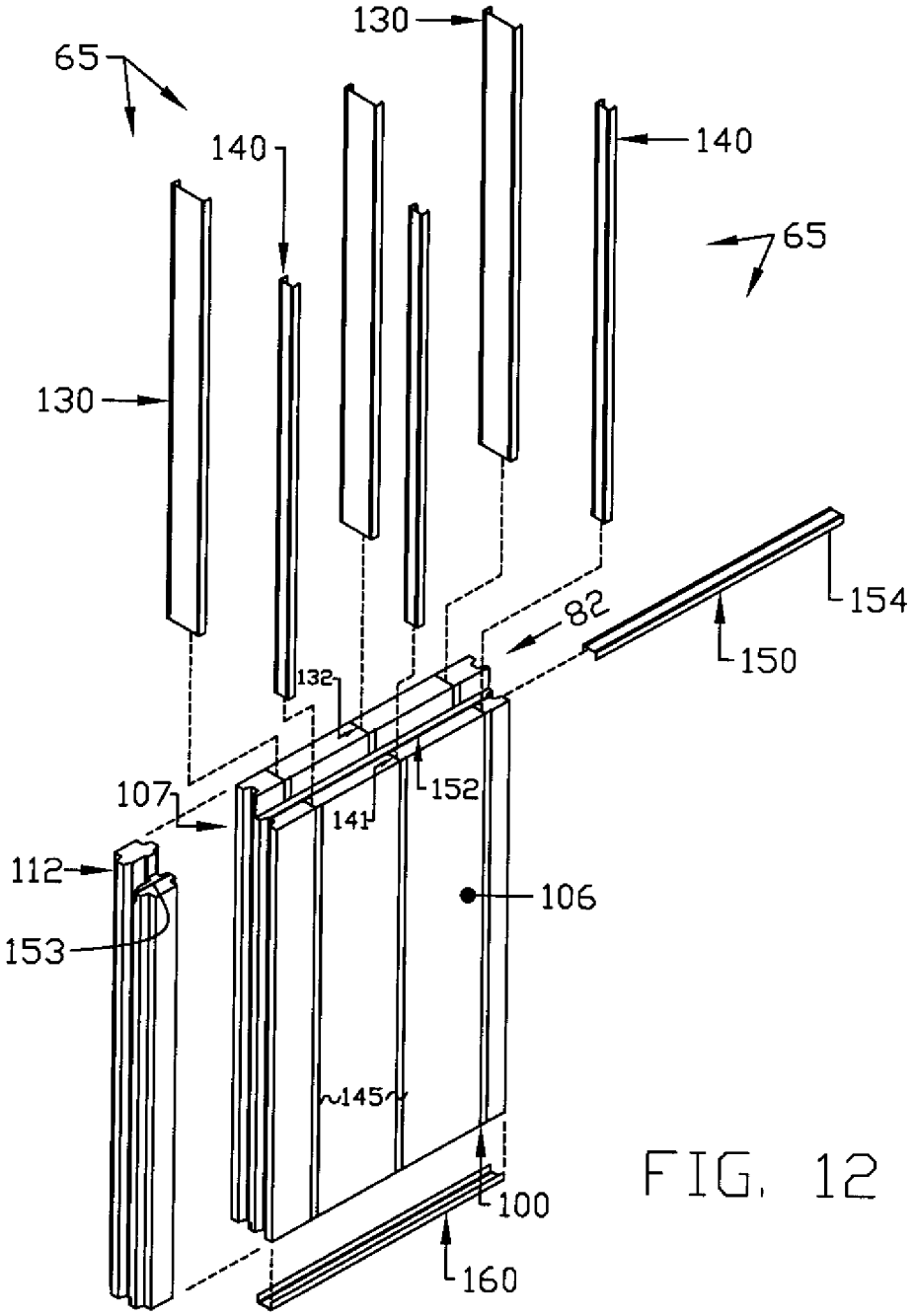
FIG. 12 is an exploded, rear, isometric view of a preferred wall panel and a preferred end adaptor of FIGS. 6-11, with the outside surfaces facing the viewer.
Figure 15:
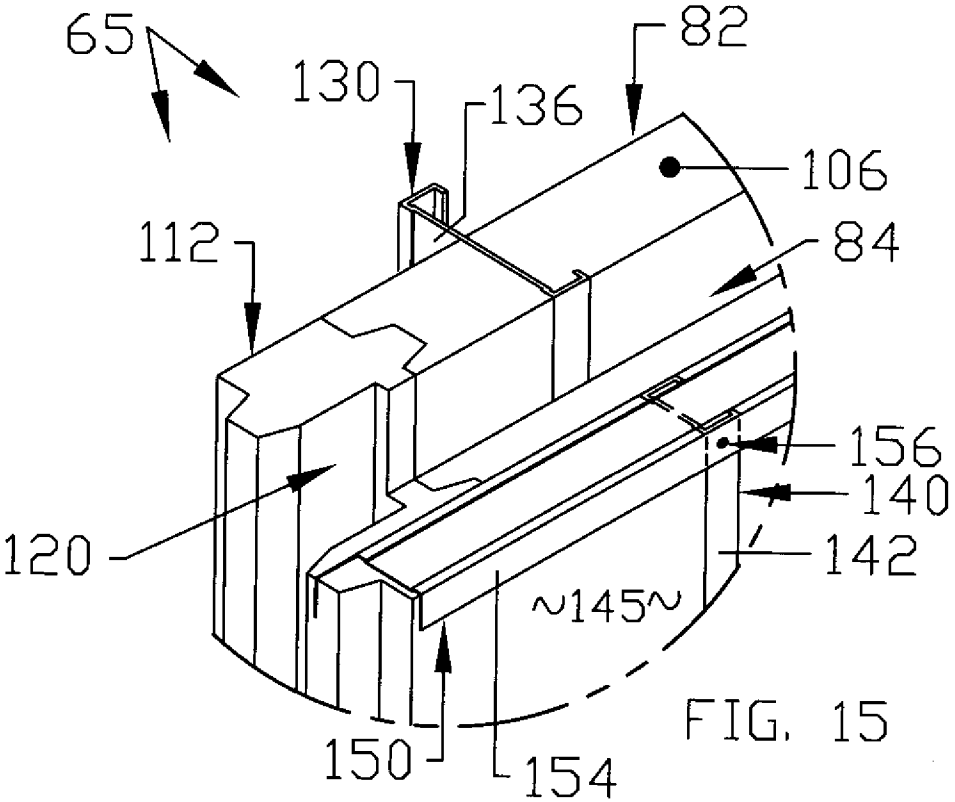
FIG. 15 is an enlarged, fragmentary isometric assembly view derived generally from circled region 15 in FIG. 13, with portions thereof broken away for clarity.

Noting FIG. 12, for example, the wall panel module 65 preferably has several major channel reinforcement struts 130 that extend vertically up and down within narrow, longitudinal slots 132 (FIG. 12) formed in the wall panel body 106. As seen in FIGS. 9 and 15, a substantial portion of each major channel strut 130 is nested and captivated within the wall panel body 106, being snugly fitted within slots 132. However, an offset, external portion 136 (i.e., FIGS. 7, 8, 10, 14, 15) of the major struts 130 projects away from the frontal surface of the EPS panel body 106. As used herein, the term "frontal" or "inside" refers to that portion of the various panels discussed herein that form the insides of the finished enclosure 50. These offset portions 136 (i.e., FIGS. 14, 15) are directed towards the interior of the enclosure 50 to provide support for internal finishing.

Each wall panel 65 also has a plurality of complementary, minor channel struts 140 that are shorter and narrower than the major reinforcement struts 130. Struts 130 may be six inches wide, and the minor struts 140 may be three inches wide. The minor struts 140 are located on the "outside" surface of the wall panels 65, and they do not have a portion that is offset from the plane of the wall panel, as do major struts 130. Struts 140 that are fitted to and snugly nest within the narrow slots 141 (FIG. 12) longitudinally defined in the wall panel body 106. The exterior flange edge portions 142 of struts 140 exteriorly contact the wall panel surfaces 145 (FIGS. 12, 15) facing outwardly.

When the modular wall panels 65 are aligned and adhesively coupled together to form a wall, the spaced apart and parallel major struts 130 present numerous offset portions 136 that extend away from the interior wall panel surface (i.e., FIGS. 3, 7, 8, 10). The offset strut portions 136, which are accessible within the enclosure 50 during construction, collectively present anchoring structure to which interior finishing such as Gypsum wallboard or the like may be secured. Thus interior wall finishings 139 (FIGS. 3, 4) may be secured to and mechanically fastened to the exposed strut portions 136. During assembly, the void region between various modular panels and the finishing surface coupled to the offset strut portions 136 forms a chase 133 (FIG. 3) through which electrical wiring, satellite cable television wiring, plumbing and the like may be positioned and routed.

Importantly, the vertical reinforcing struts 130, 140 do not establish a metallic conduction path through the wall panel 65. In other words, both the interior, major struts 130 and the exterior, minor struts 140 terminate short of each other without metal-to-metal contact, within the mass of the EPS plastic panel bodies 106. Moreover, while there are externally exposed portions of the major or minor struts 130 or 140, the struts do not extend 8 through the entire thickness of the panel body 106, so that a conduction heat path from the inside of the enclosure 50 to the outside is not established. Since both struts 130 and 140 are channels, given their orientation, the metallic strut portions reinforce the EPS panels in directions aligned with the panel longitudinal axis, a direction extending along the panel width, and a direction perpendicular or normal to the panel thickness.

Figure 13:
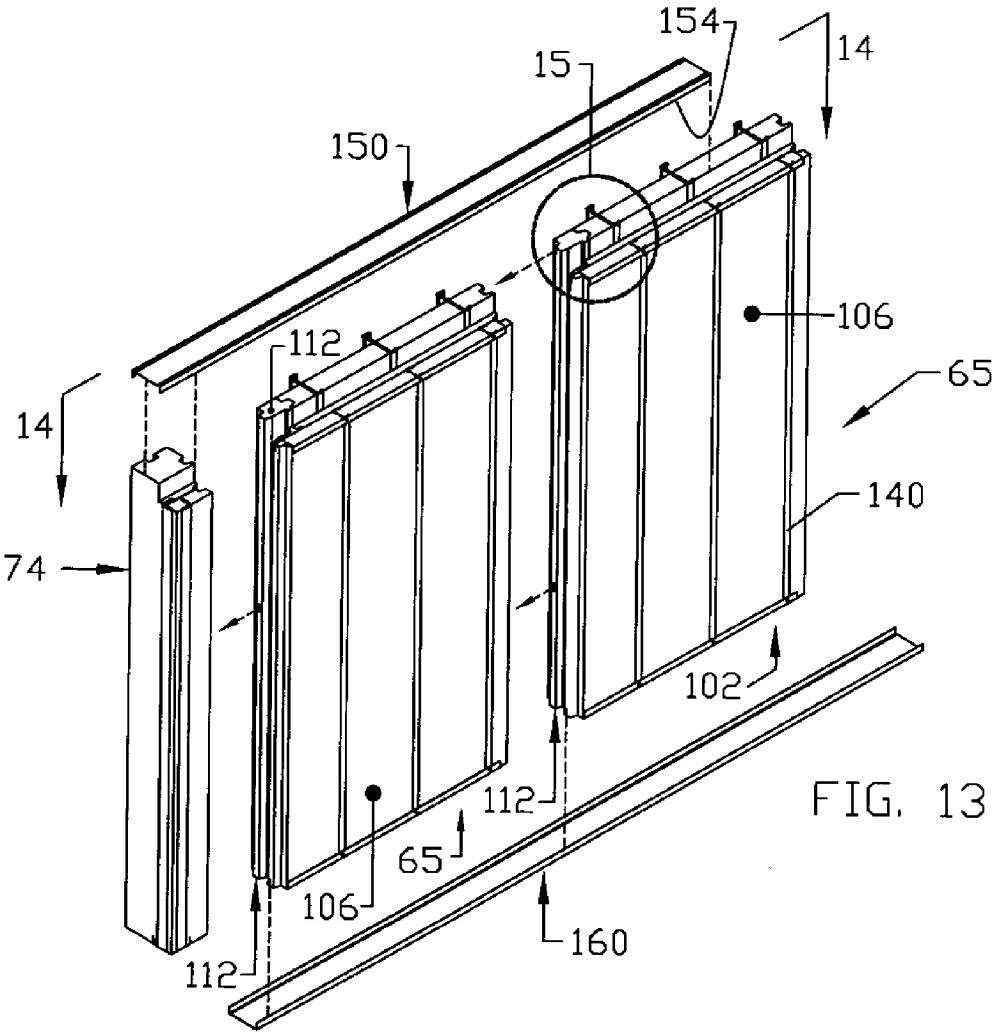
FIG. 13 is an exploded, rear, isometric view of a partially assembled wall comprising two of the preferred, modular wall panels of FIG. 6, each with a preferred panel end adaptor, and showing a preferred, modular corner junction.

Each modular wall panel preferably comprises at least two horizontally oriented steel channel struts 150 and 160 (FIG. 12) for additional reinforcement. The horizontal struts are spaced apart from, and do not touch, any of the major vertical struts 130 discussed above, so that a thermal conduction path from the enclosure interior to the enclosure exterior through the metal struts is avoided. In FIGS. 12 and 13 for example, the upper horizontal channel struts 150 are fitted within upper horizontal slots 152 (FIG. 12) within the upper wall panel notched region 104 (FIG. 15) discussed earlier and continue through aligned, upper slots 153 (FIG. 12) in the adaptors 112. The exposed outer flange edge 154 (FIGS. 6, 12, 13) of struts 150 provides a metal, reinforced edge for strength. As seen in FIG. 15, the upper horizontal struts 150 may be secured to the exposed, external flange portions 142 of vertical struts 140 discussed above by fasteners 156 (FIG. 15) for strength. Complementary, lower horizontal reinforcement struts 160 (FIGS. 6 and 10-13) are similar in size and shape to struts 150. They reinforce the bottom of each wall panel 65 and are fastened similarly to minor channel struts 140. A lower wall panel strut 160 is seen in FIG. 5 resting upon slab 52. Importantly, after assembly, a larger width strut 157 (FIGS. 2, 5) affixed to the slab 52 borders the narrower strut 160 affixed to the wall panel 65, and receives the inner, bottom edge of the wall panels 65. Preferably the entire concrete slab 52 (FIG. 2) is circumscribed by aligned struts 157 that are secured to the floor prior to erection of wall panels. Their purpose is to anchor the wall panels 65 and other panels. Strut 157 (i.e., FIG. 3), and the panel major struts above it, are offset as described earlier. This means that when a finishing surface 139 (FIG. 3) is attached as aforesaid, electrical or cable wiring, plumbing pipes 131 and the like may be located within the hollow chase 133.

Preferably the enclosure is secured to the supporting surface or slab with a strapping or cabling tie-down system. As viewed in FIG. 5, captivated anchor bolt 57 anchors a strap 59 that is routed through the panels and interconnected panel structures described later to prestress and brace the enclosure 50. The strap extends to a similar anchor bolt on the other side of the enclosure. Preferably there are anchor bolts disposed every four feet along both sides of the enclosure 50 within surface 52 for multiple straps for pretensioning. As seen in FIG. 4, strap 59 is routed through routing groove 120 within the end of a panel or adaptor 112 occupying void routing 121 (FIG. 7) and being routed upwardly through the lower, notched region of the roof panel 80. The strap 59 seats within an edge of the steel channel 322 (FIG. 30) discussed below that is secured within sides of the roof panels, and is thus able to nondestructively distribute force and pretension the enclosure 50. Several such tensioned straps can be routed from anchor bolts on one side of the slab over the enclosure to bolts on opposite sides of the slab.

The multidirectional, three-dimensional reinforcing action of the combined struts 130, 140, 150, and 160 is a result of their orientation as described, plus their channel cross section. As a result of the reinforcement strut configuration described, the compression strength for the load bearing panels is increased. Moreover, tensile strength is increased as well in part because of the channel cross section of the multiple reinforcement struts. Furthermore, no interior strut touches any exterior strut, and no strut completely penetrates the EPS wall panel body 106 from front to back. so there is no conduction heat path loss through any metal-to-metal pathway. Similar thermodynamic and structural advantages that are achieved concurrently with high panel strength are exhibited by all panels described herein, all of which preferably share the basic reinforcement strut configuration as the wall panel 65.

With joint reference directed now to FIGS. 16 and 17, the corner junction 74 structurally forms a right angle junction between intersecting, coupled panels. The elongated, EPS corner junction 74 will occupy the resultant corner formed by interconnecting panels or adaptors. Each corner junction 74 is preferably notched or stepped like the wall panels 65 discussed above, comprising a notch 161 at its top that will align with the other stepped panels upon assembly. Corner junction sides 162, 164 are elongated and substantially rectangular. Side 165 that faces the viewer in FIG. 16 has a tongue-an-groove connector arrangement, comprising parallel, spaced-apart elongated tongues 167 disposed on opposite sides of the grooves 168 (FIG. 16). The adaptor tongues 118 (FIG. 7) can mate with and seat within grooves 168 in the corner junction 74 when the two pieces are glued together. There is also a groove 170 formed in the side that is disposed at a right angle to side 165. Groove 170 can receive an alignment key discussed below associated with an EPS gable panel.

Each corner junction 74 is reinforced by angled, structural steel struts. Sides 162 and 164 (FIG. 17) include thin slots 174, 176 to which angled struts 178, 180 respectively are press-fitted and glued. The outermost corner 182 of the corner junction 74 (FIG. 17) is shrouded by the side flange portions 183, 184 of the struts 178, 180 respectively. The steel-covered corner 182 of the corner junctions 74 will project outwardly from the corners of the enclosure 50 after assembly.

The modular door panels 70 (FIGS. 18-21) are constructed similarly to the wall panels discussed above. Each door panel 70 has a central EPS body portion 190 whose opposite, female ends each comprise integral tongues 192 and grooves 193 (i.e., FIG. 21). The body portion 190 may be glued to elongated adaptors 112 which were detailed above (i.e., FIGS. 8, 11), in a similar fashion as the wall panels 65 discussed earlier. Adaptor 112 has tongues 114 and grooves 116 (FIG. 8) that mate with tongues 192 and grooves 193 (FIG. 21) in the door panel ends. Adaptor 112 then enables connection of the door panel to other panels such as window or wall panels. As viewed in FIG. 20, the EPS body portion 190 of door panel 70 is stepped, including a notch 195, to match the stepped profile of other panels to which adaptor 112 is fastened.

Figure 18:
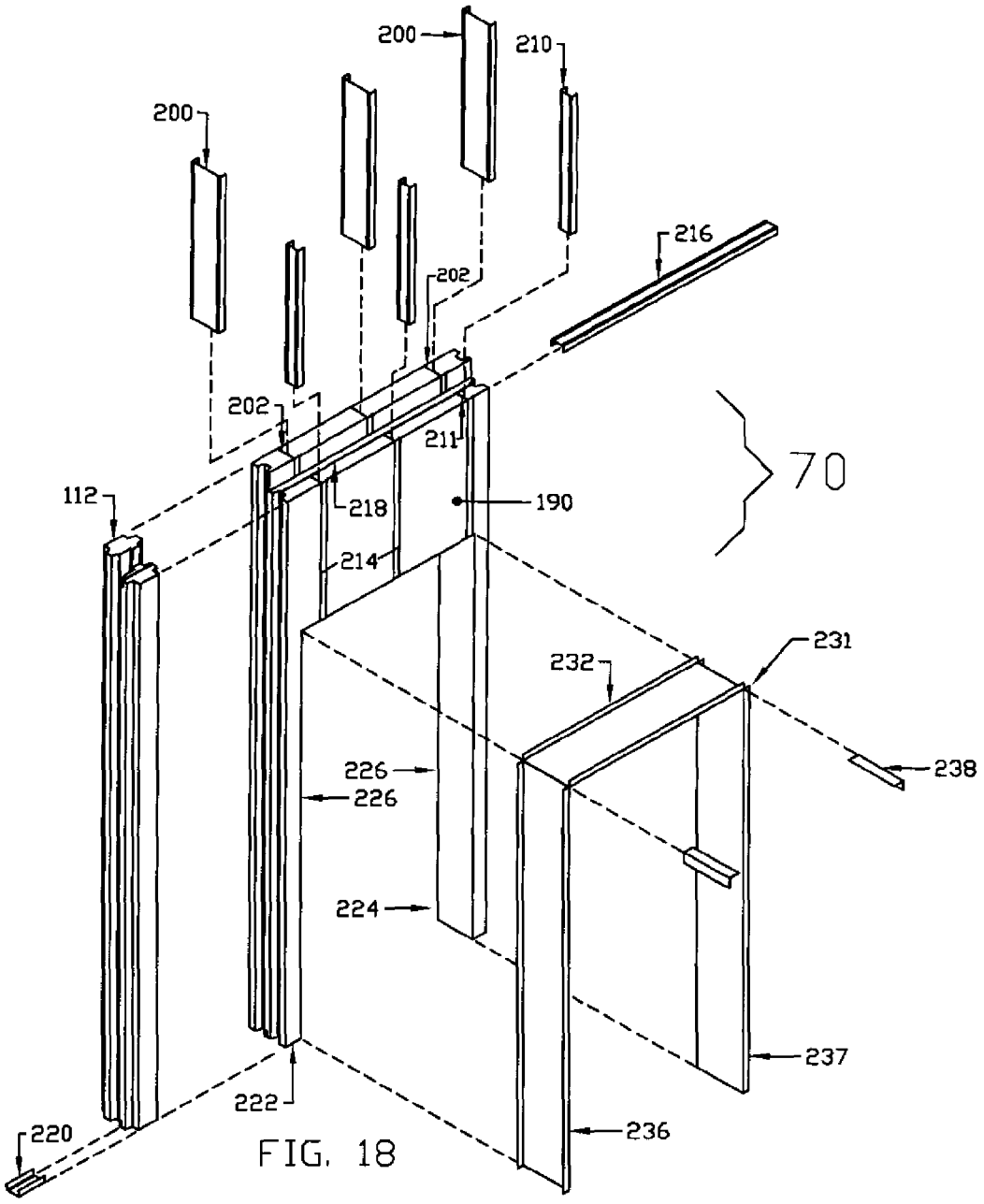
FIG. 18 is an enlarged, exploded rear isometric view of a preferred door panel.
Figure 19:
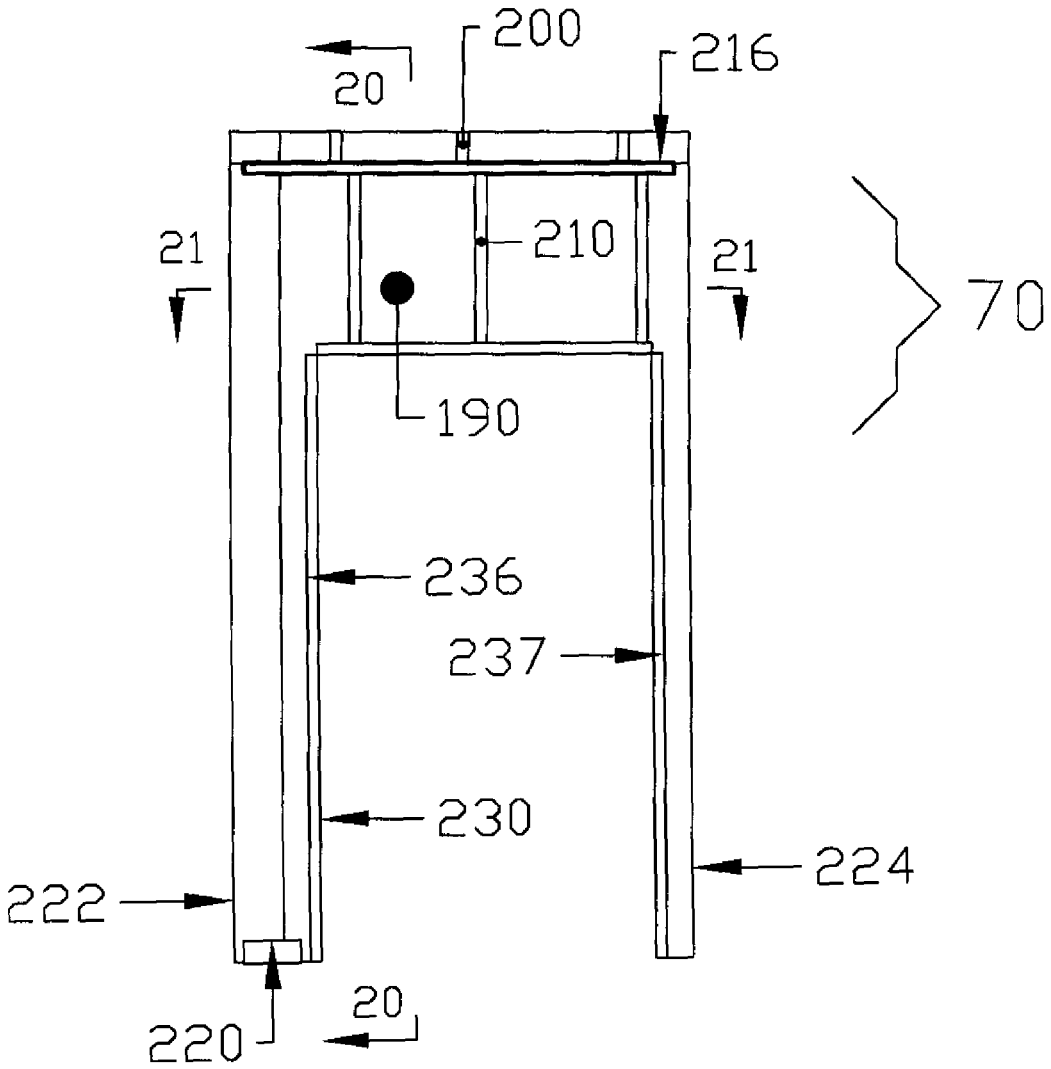
FIG. 19 is an enlarged, rear plan view of the preferred door panel.
Figure 20:
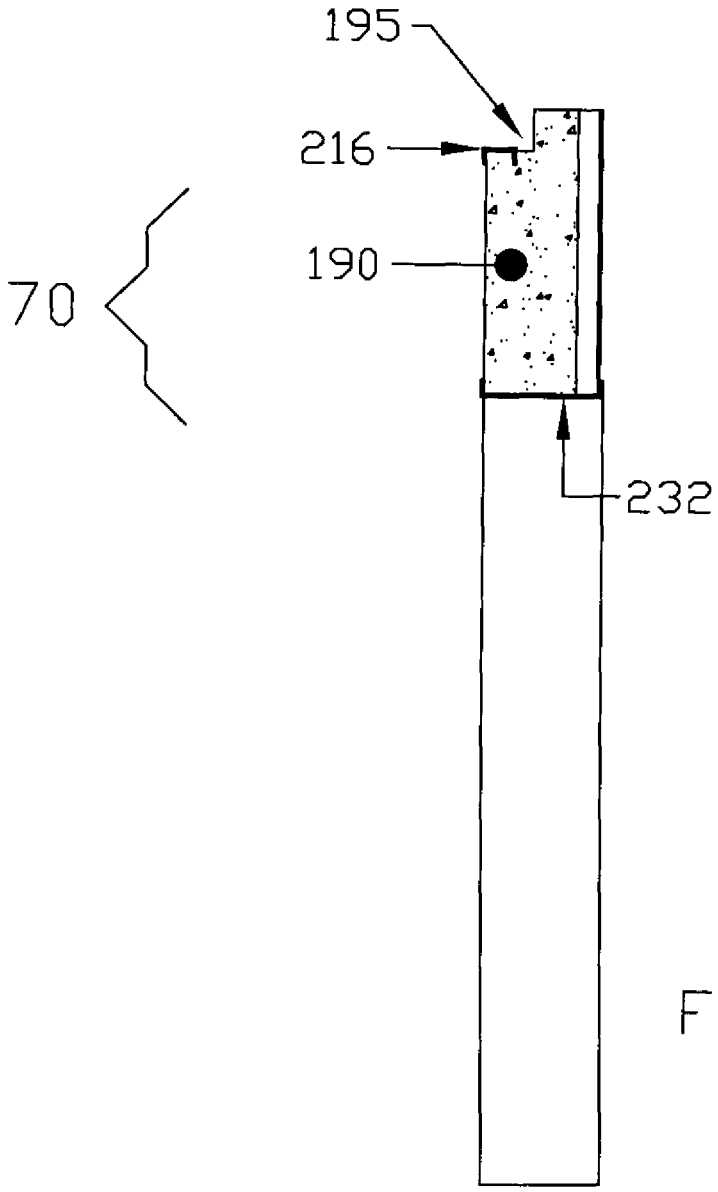
FIG. 20 is an enlarged, longitudinal sectional view of the preferred door panel, taken generally along line 20-20 in FIG. 19.
Figure 21:
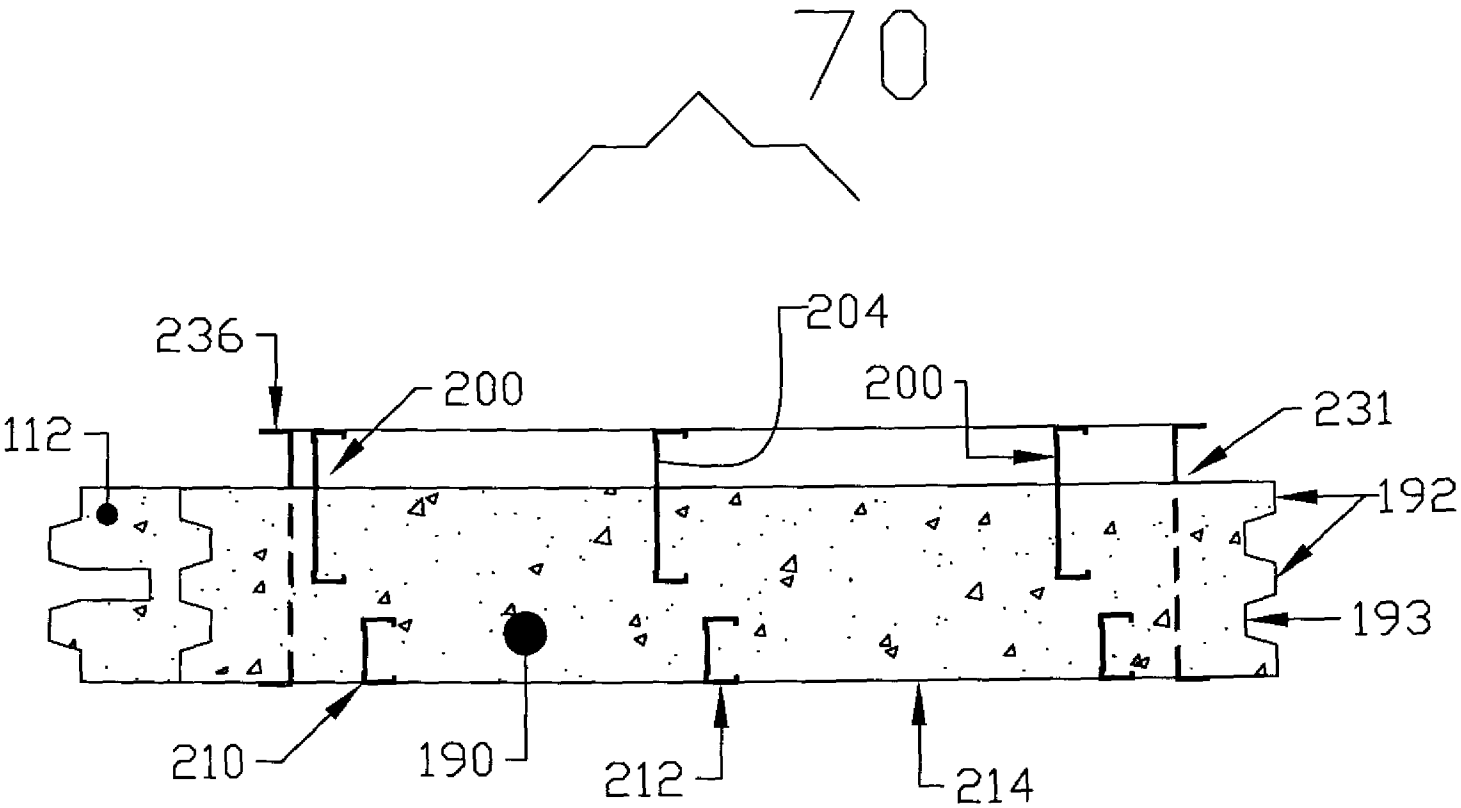
FIG. 21 is an enlarged, vertical sectional view of the preferred door panel, taken generally along line 21-21 in FIG. 19.

Like the wall panels 65 discussed earlier, each door panel 70 preferably has a plurality of elongated reinforcement struts that are fitted through predefined slots in the EPS structure. Noting FIG. 18, the door panel 70 preferably comprises three major channel struts 200 which are similar to the major struts 130 on the wall panels 65 discussed earlier. The major struts 200 extend vertically up and down within narrow slots 202 (FIG. 18). As appreciated frown FIG. 21, substantial portions of each major channel strut 200 are captivated within the door panel body portion 190. Offset, external strut portions 204 (i.e., FIG. 21) project away from the interior surface of the door panel 70 to form a mounting surface for desired finishings as discussed earlier. Each door panel 70 also has a plurality of narrower, minor channel struts 210 that are fitted to narrow slots 211 (FIG. 18) defined in the door panel body portion 190. The exterior, flange edge portions 212 of the narrower minor struts 210 are flush with the door panel outer surface 214 (FIGS. 18, 21). An upper horizontal channel strut 216 (FIG. 18) is fitted to an upper slot 218 (FIG. 18) within the top of the door panel 70. As seen in FIGS. 18 and 19, the horizontal struts 216 may be secured to the vertically oriented, minor struts 210 for strength. Referencing FIGS. 18 and 19, lower horizontal, reinforcement struts 220 are affixed beneath the vertical legs 222 and 224 of the door panel 70 and contact the slab 52. Lower struts 220 axially align with struts 160 (FIG. 13) on neighboring wall panels in assembly. They are fastened in the same manner as upper horizontal struts 216 (i.e., FIG. 19).

It will be noted that there is a rectangular void 226 between the door panels legs 222 and 224 (FIG. 18) for installation of a door assembly. To this effect there is a channel steel, door frame 231 (FIG. 18) that is fitted within void 230. The upper channel portion 232 of the door frame 231 is glued beneath the door panel body portion 190 above the void 226. Door panel legs 222 and 224 are received by and glued to the left and right sides 236, 237 (FIGS. 18, 19) respectively of the door frame 231. Angle steel retainers 238 (FIG. 18) secure the door channel corners. Referencing FIG. 21, it will be seen that the door frame 231 is wider than the EPS body portion 190, and thus channel door frame sides 236, 237 projects from and are offset with respect to the central door frame portion 190, like projecting strut portions 204 in FIG. 21. Again, this preferred offset construction characterizing the reinforcement strut configuration with all panels described herein facilitates the installation of interior finishing and the like.

Figure 22:
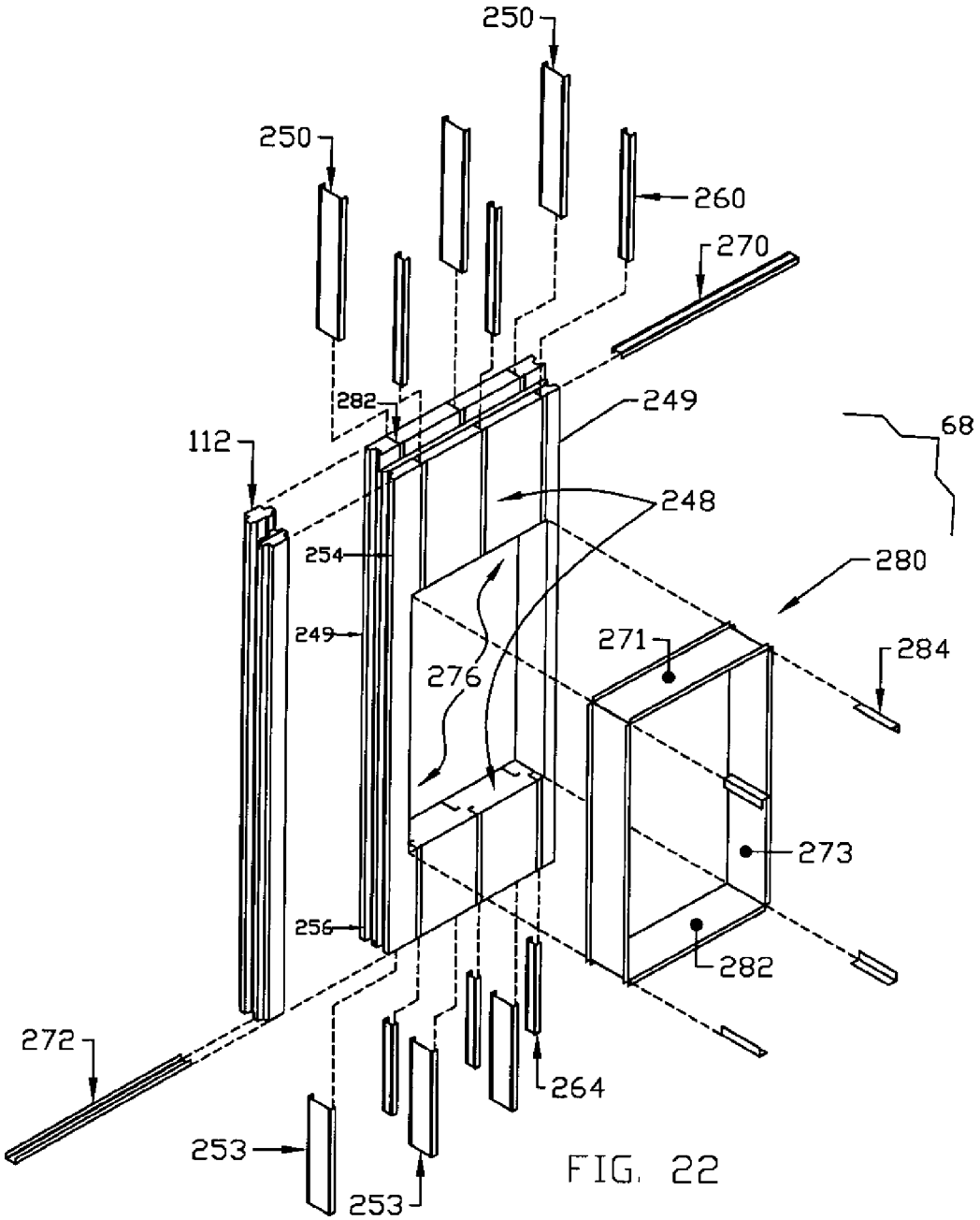
FIG. 22 is an enlarged, fragmentary, exploded, rear isometric view of a preferred window panel.
Figure 23:
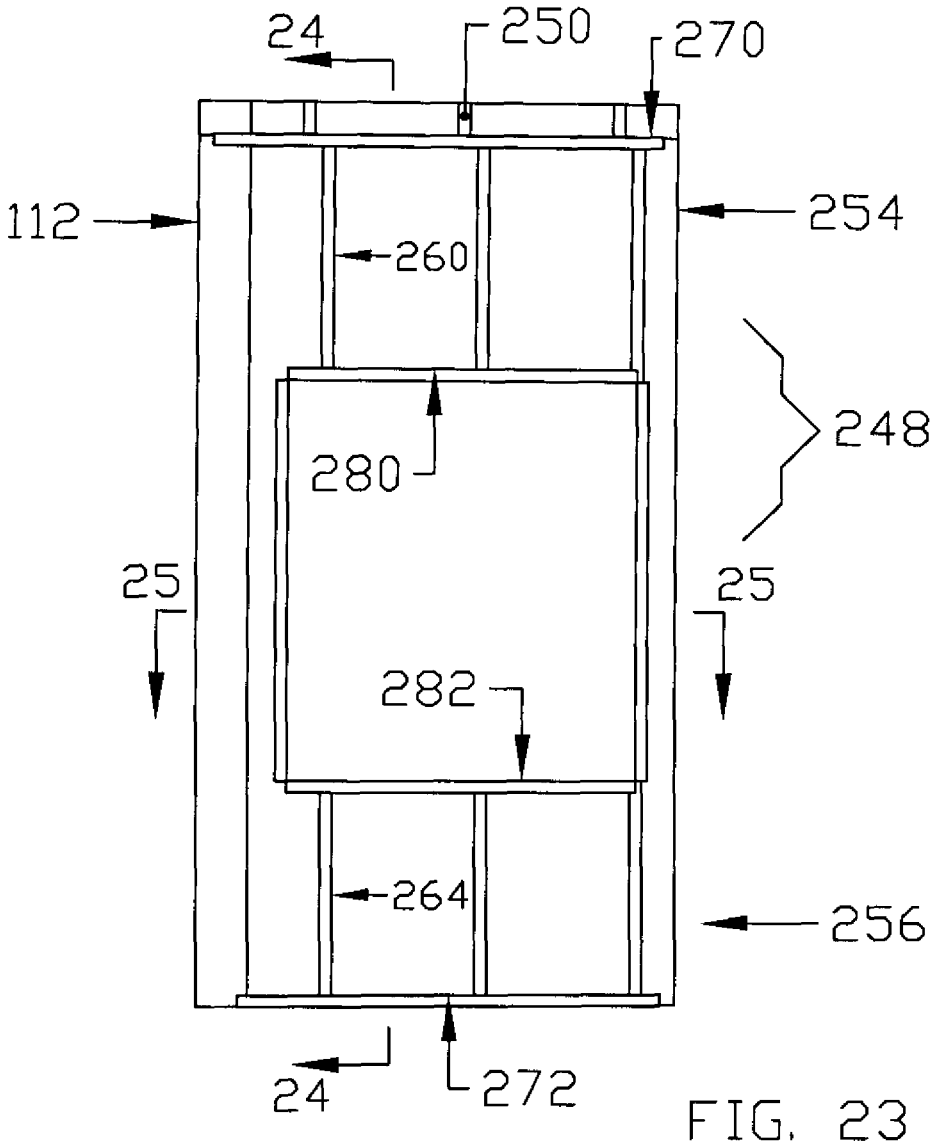
FIG. 23 is an enlarged, rear plan view of the preferred window panel.
Figure 24:
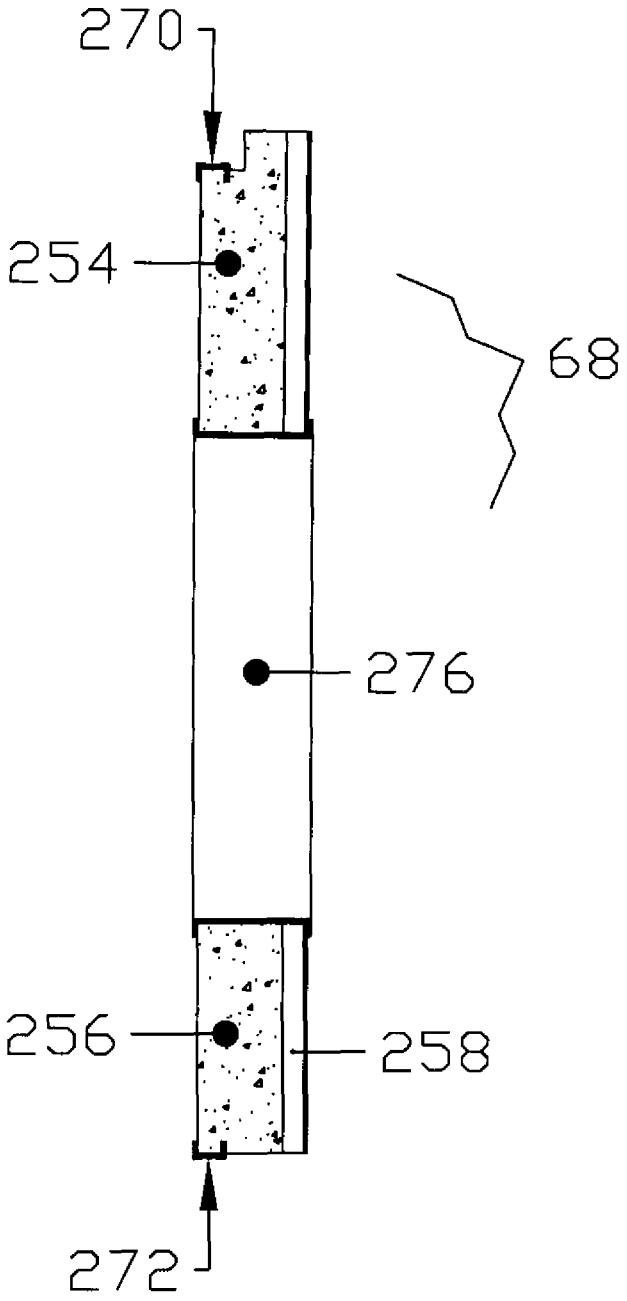
FIG. 24 is a longitudinal sectional view of the preferred window panel, taken generally along line 24-24 in FIG. 23.
Figure 25:
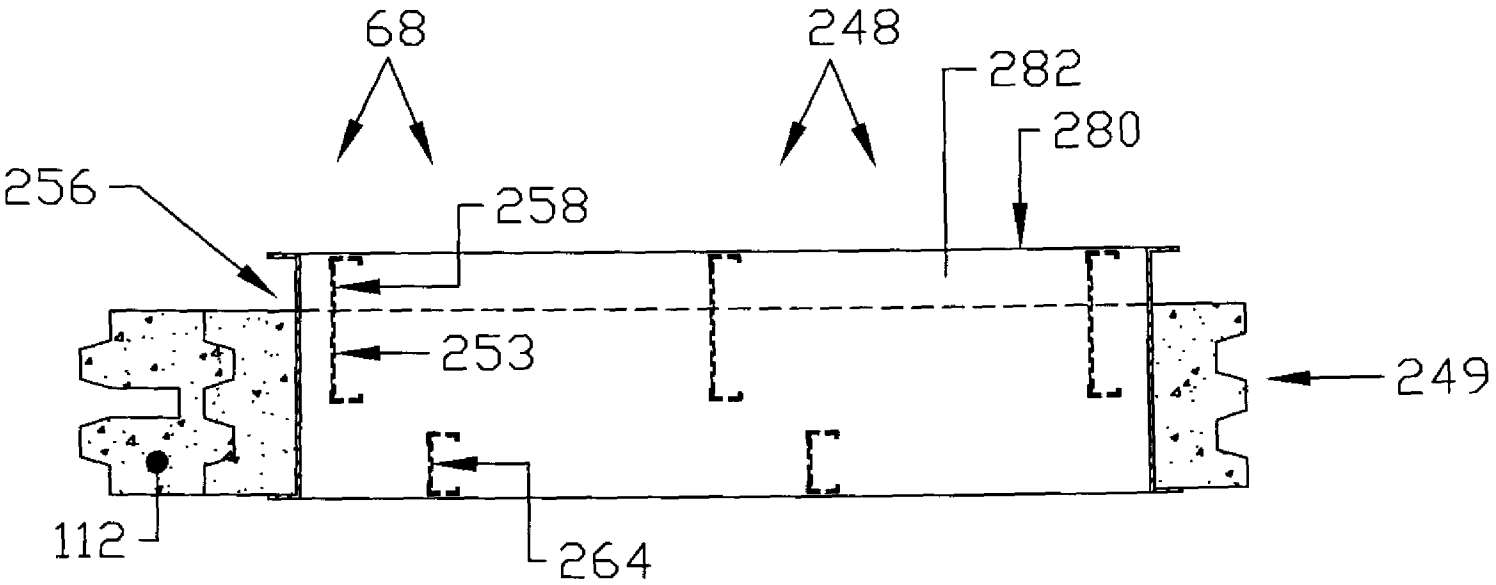
FIG. 25 is a vertical sectional view of the preferred window panel, taken generally along line 25-25 in FIG. 23.

Referencing now to FIGS. 22-25, the preferred window panels 68 are similar to the wall panels 65 and the door panels 70 described above. Each window panel has the tongue and groove construction described earlier, and each fits with an end adaptor 112 (i.e., FIGS. 22, 25) described earlier. EPS window panel body 248 (FIG. 22) has edges 249 with tongue and groove couplings (FIG. 25). Preferably, several elongated reinforcement struts are fitted through predefined slots in the EPS window panel body 248. Noting FIG. 22, there are several, upper, major channel struts 250 that extend vertically through narrow slots 252 (FIG. 22) defined in the upper half 254 of window panel body 248. Companion lower, wide, major channel struts 253 are fitted to the lower half of window panel body 248. Substantial portions of each wide channel strut 250, 253 are captivated within the window panel body 248, but there are offset, external strut portions as before. For example, FIG. 25 reveals that lower wide struts 253 have offset strut portions 258 that project away to form an interior mounting surface for finishings. Each window panel 68 also has a plurality of upper, narrow channel struts 260 (FIG. 22) fitted to the upper half 254 of the window panel body 248. A plurality of axially aligned, lower, narrow reinforcement struts 264 align with struts 260 above (FIG. 22). There is an upper, horizontal channel strut 270 (FIGS. 22, 24) fitted to upper half 254 within the stepped, top of the window panel. A companion bottom, horizontal channel strut 272 (FIG. 22) fits to the bottom half 256 (FIG. 24). As seen in FIG. 23, the horizontal struts 270, 272 may be secured to the external, minor vertical struts 260, 264 respectively.

Referencing FIG. 22, there is a rectangular void 276 defined in the window panel body 248 of each window panel 68 in which a window assembly may be mounted. Rigid, generally rectangular, channel steel, window frame 280 is fitted within void 276. Frame 280 comprises an upper channel top 271, integral, spaced apart sides 273, and an integral, lower channel bottom 282 (FIG. 22). The window frame 280 is deeper than the thickness of the EPS panel, so the window frame is offset. For example, the lower channel bottom 282 (FIGS. 22, 25) of the window frame 280 is visibly offset from the EPS panel with strut portions 258. Angle steel retainers 284 (FIG. 22) secure the window frame channel corners. Referencing FIGS. 21 and 25, the window frame 280 is wider than the EPS window panel body 248, and thus window frame bottom channel 282 (FIG. 25), for example, projects from and is offset with respect to the body 248. Again, this offset construction characterizing the reinforcement strut configuration with all panels described herein, facilitates the installation of interior finishing 139 (i.e., FIG. 3).

Referencing FIGS. 22-25, the window panels 68 include tongue and groove couplings that are similar to the wall panels 65 and the door panels 70 described above. Each window panel can receive an end adaptor 112 (i.e., FIGS. 22, 25) described earlier. Central window panel body 248 thus has tongue and groove ends 249 (FIG. 25).

A plurality of elongated, reinforcement struts are fitted through predefined slots in the EPS window panel body 248. Noting FIG. 22, there are several, upper, wide channel struts 250 that extend vertically through narrow slots 252 (FIG. 22) defined in the upper half 254 of window panel body 248. Companion lower, wide channel struts 253 are fitted to the lower half of central window panel body 248. Substantial portions of each wide channel strut 250, 253 are captivated within the panel body 248, but there are offset, external strut portions as before. For example, FIG. 25 reveals that lower wide struts 253 have offset strut portions 258 that project away to form a mounting surface for finishings. Each window panel 68 also has a plurality of upper, narrow channel struts 260 (FIG. 22) fitted to the upper half 254 of the window panel body 248. A plurality of axially aligned, lower, narrow reinforcement struts 264 align with struts 260 above (FIG. 22). There is an upper, horizontal channel strut 270 (FIGS. 22, 24) fitted to upper half 254 within the stepped, top of the window panel. A companion bottom, horizontal channel strut 272 fits to the bottom half 256 (FIGS. 22, 24). As seen in FIG. 23, the horizontal struts 270, 272 may be secured to the vertical struts 260, 264 respectively.

Figure 26:
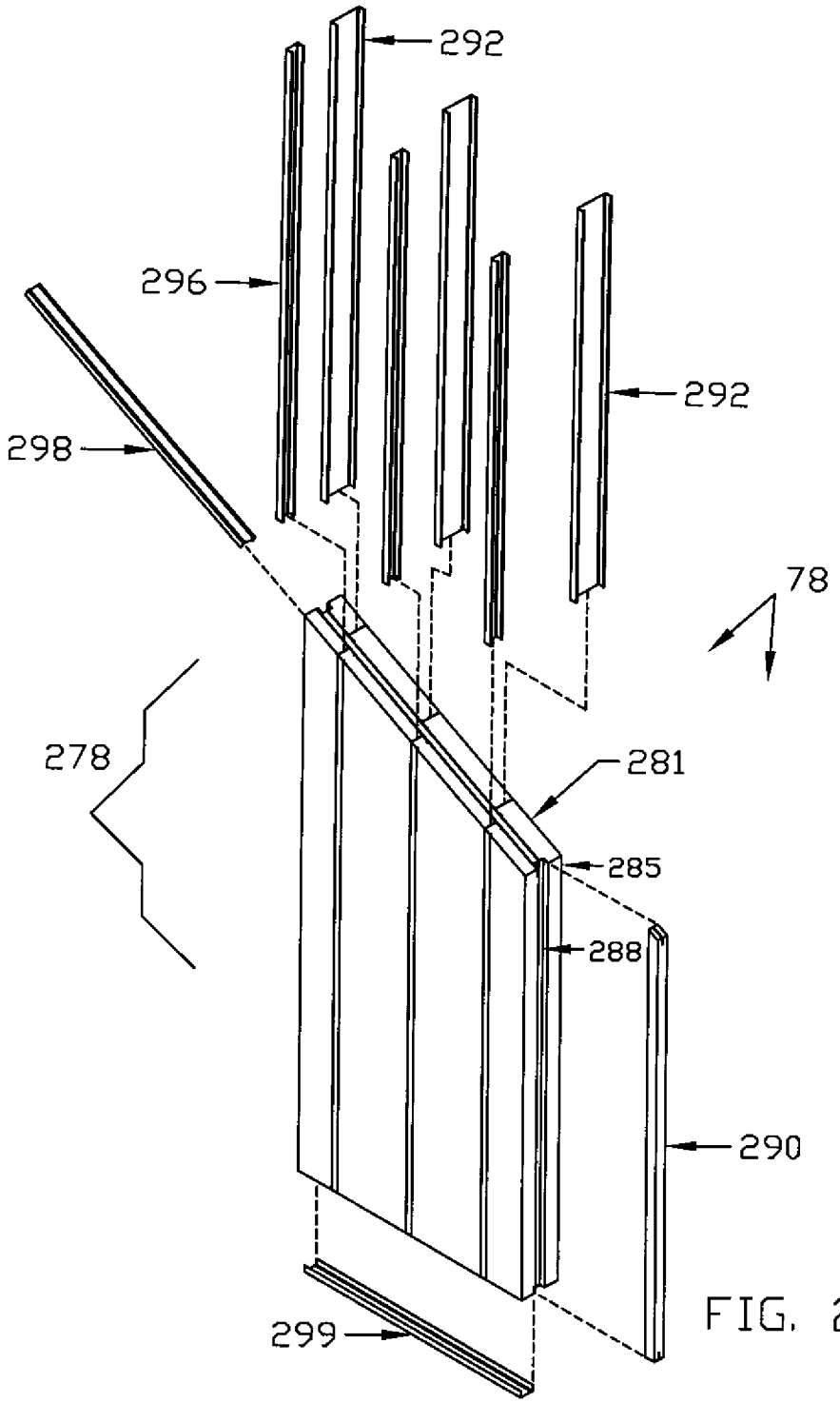
FIG. 26 is an exploded, rear isometric view of a preferred gable panel.
Figure 27:
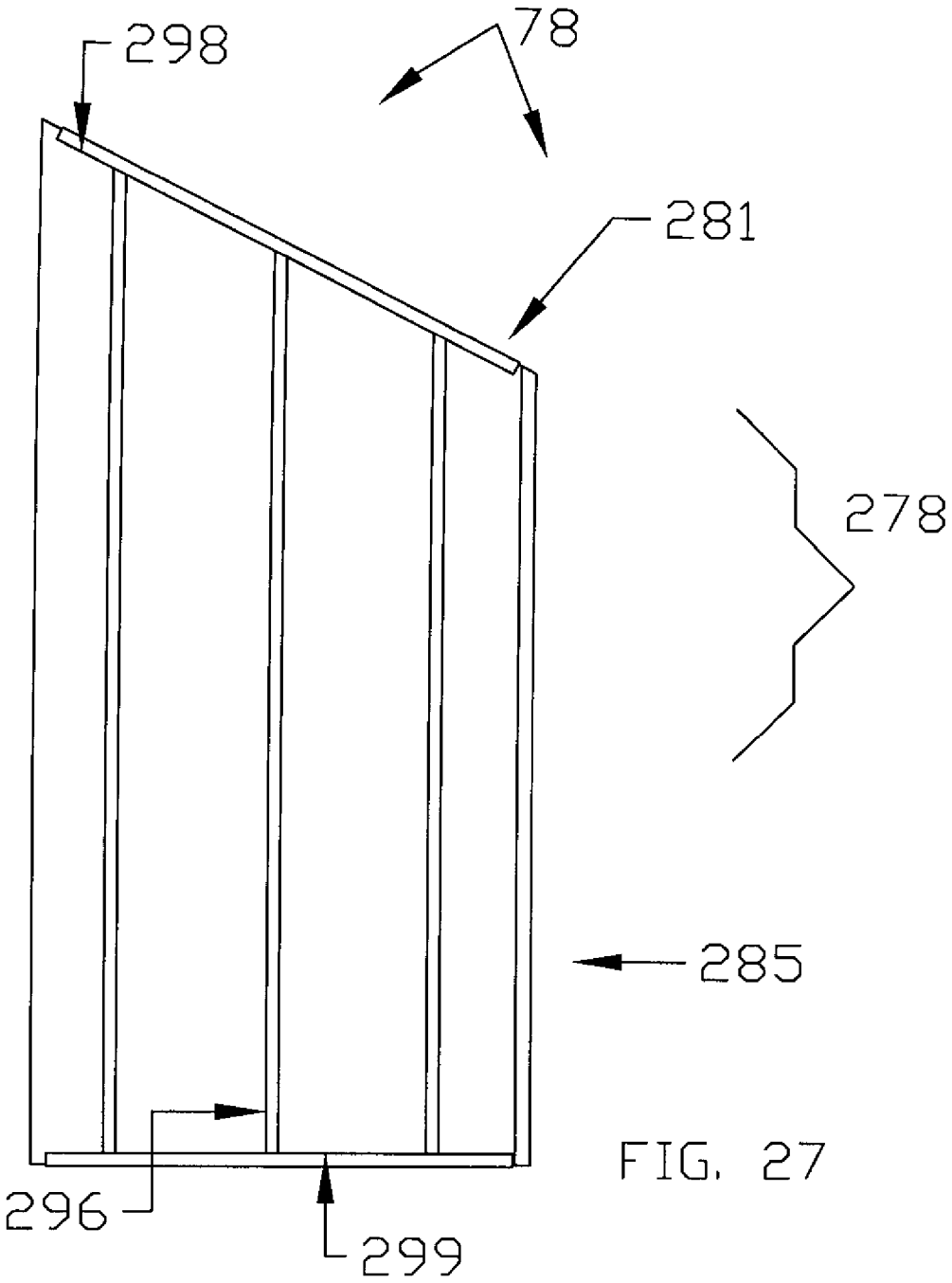
FIG. 27 is an enlarged rear plan view of a preferred gable panel.
Figure 28:
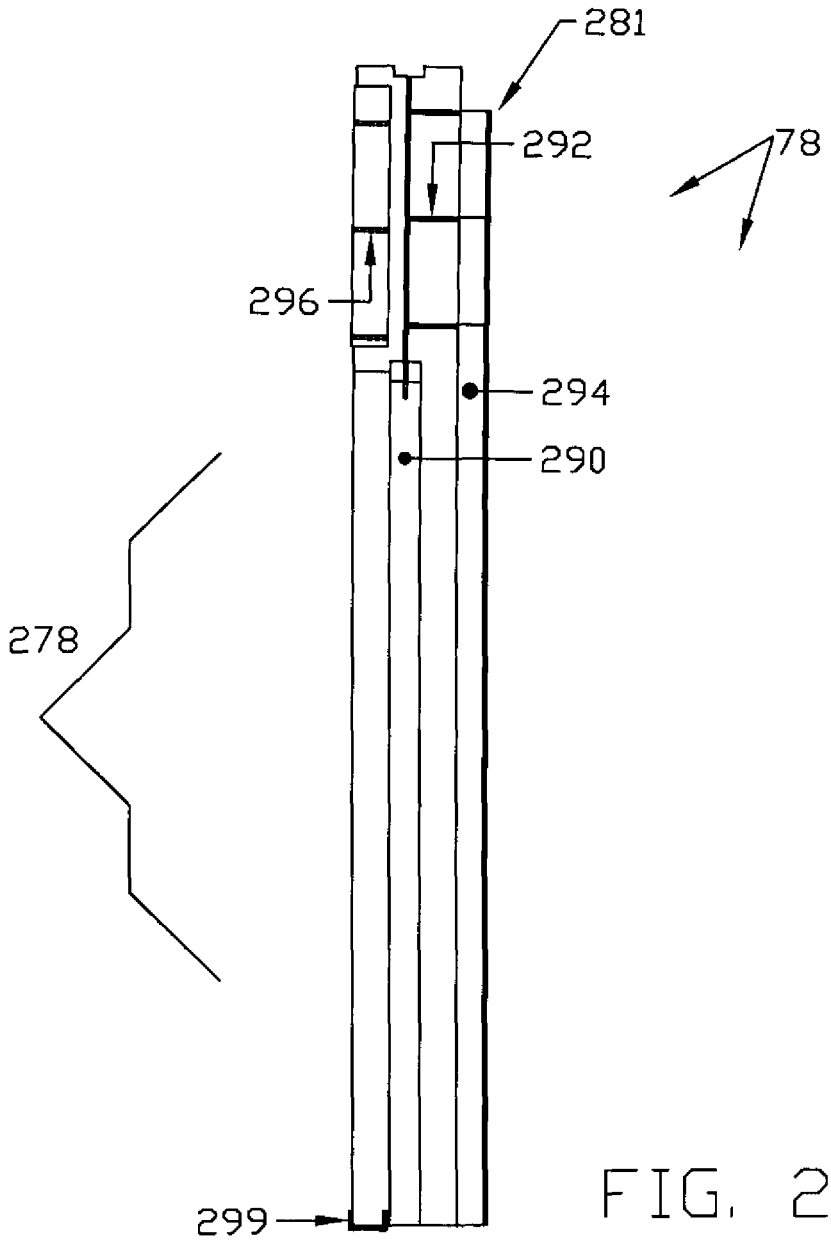
FIG. 28 is an end elevational view of the preferred gable panel, taken generally from the right of FIG. 27.
Figure 29:
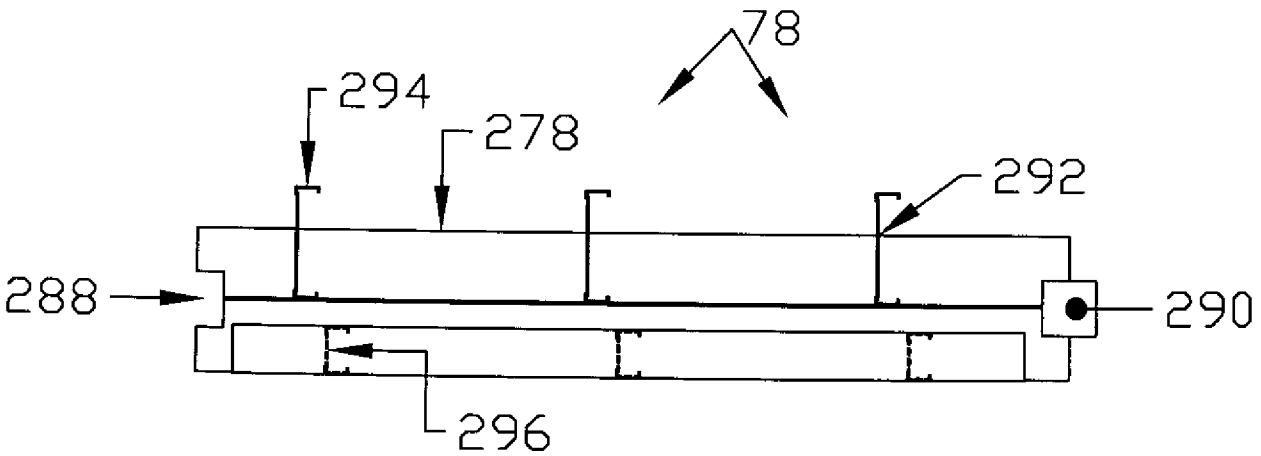
FIG. 29 is a top plan view of a preferred gable panel, taken generally from above FIG. 27 and looking down.

The end walls 78 are similarly made of modular EPS structures reinforced as aforesaid. The modular gable panels 78 are formed primarily of EPS plastic, and they are similar to wall panels 65, window panels 68, and door panels 70 detailed earlier. However, each EPS gable panel body 278 has an inclined top 281 (FIGS. 26, 27). Thus, in assembly, multiple gable panels of gradually increasing or decreasing heights must be coupled together sequentially to complete an end wall 58. Thus, in FIG. 1 for example, it will be noted that each gable panel 78A, 78B, 78C, and 78D of gradually increasing height generally borders a shorter gable panel on one side and a longer gable panel on an opposite side. The inclined top of the end walls will be formed by the angularly aligned, inclined tops 281 of abutting gable panels which vary in size depending upon their position and the pitch of the roof. The extreme outer ends of the end wall 58 (FIG. 1) terminate in corner junctions 74 (FIGS. 16, 17) that enable a gable panel to interconnect at right angles with a wall panel or other panel. Gable panel body 278 has a modified tongue and groove construction that differs from that of the wall panels described earlier. Each gable panel smaller end 285 (i.e., FIGS. 25, 26) has a single, elongated groove 288 into which a single elongated alignment key 290 fits for joining adjacent gable panels. As with previously described panels, several reinforcement struts are fitted to the EPS gable panel body 278 as indicated in dashed lines in FIG. 26. With reference to FIGS. 26 and 29, there are several, major channel struts 292 that extend vertically through predefined slots as previously described. Substantial portions of each major channel strut 292 are captivated within the panel body 278 (FIG. 29). The wider major struts 292 have integral, offset portions 294 (FIG. 29) that are spaced apart from the EPS body 278 to provide an anchor for interior wall finishing. Parallel, minor channel struts 296 (FIG. 26) are vertically fitted to the external portion of the gable panels, parallel with and spaced apart from the wider major struts 292. There is an upper, inclined channel strut 298 (FIGS. 26, 27) fitted at an inclination to the stepped top of the gable panel. A companion bottom, horizontal channel strut 299 fits to the bottom. In FIG. 27 the struts 298, 299 intersect and are fastened to the narrower vertical struts 296.

Figure 30:
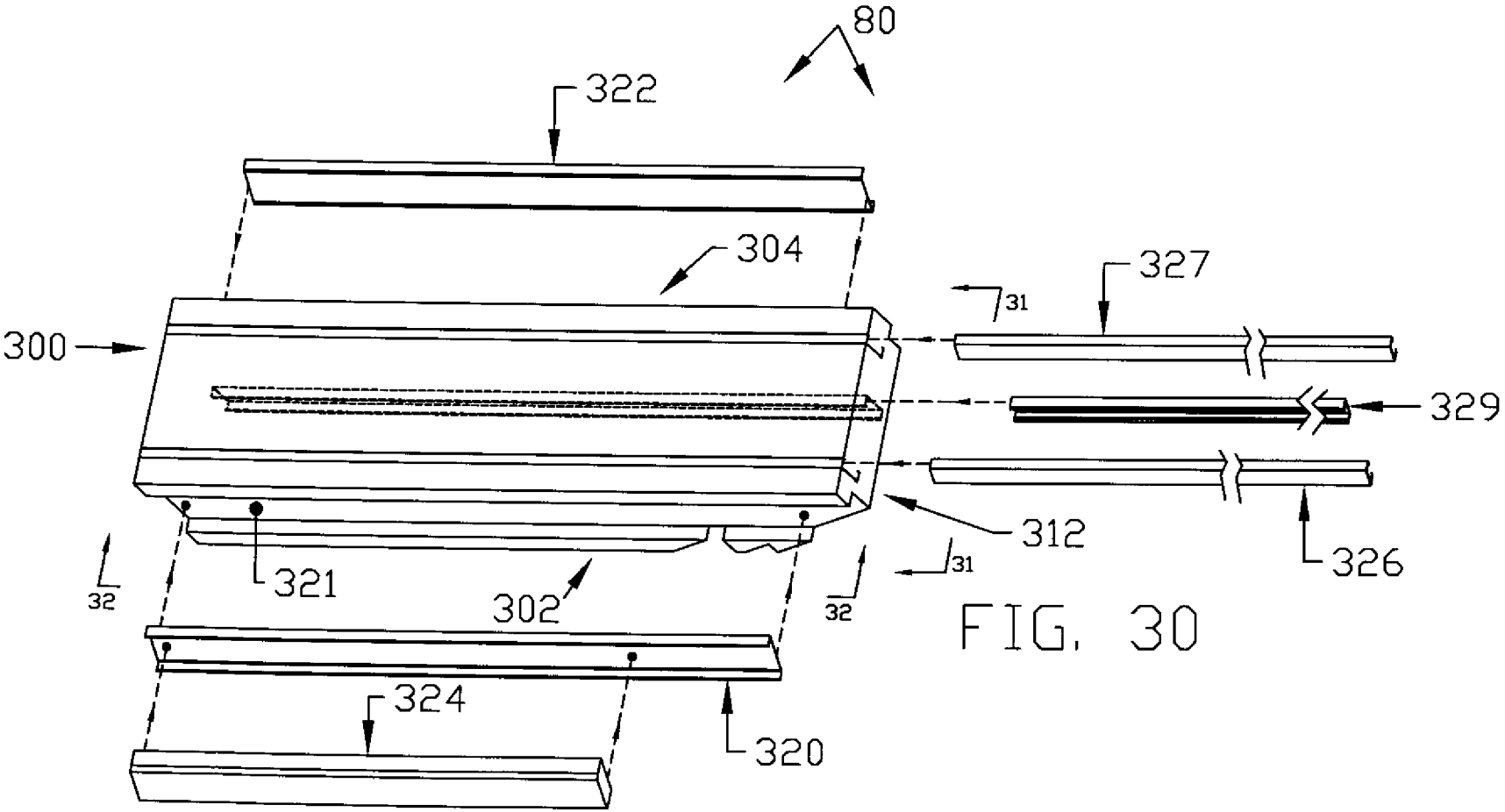
FIG. 30 is an exploded isometric view of a preferred roof panel.
Figure 31:
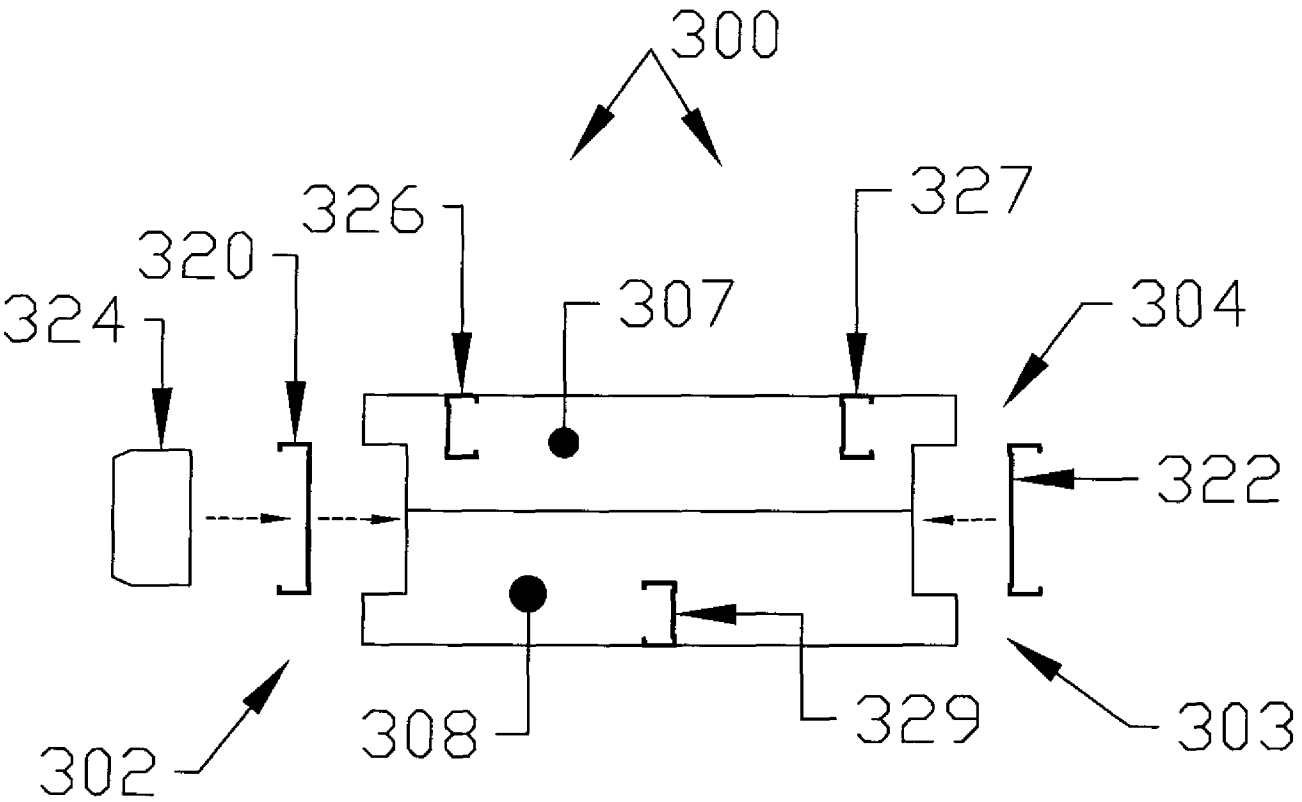
FIG. 31 is an enlarged, end elevational view taken generally along line 31-31 of FIG. 30.

The preferred modular, EPS roof panels 80 are detailed in FIG. 30. When seen from the top, the roof panel body 300 is generally rectangular. A generally rectangular side 302 faces the viewer in FIG. 30. The opposite side 304 is parallel with and spaced apart from side 302. As best viewed in FIGS. 31 and 32, there is a body comprising a top body half 307 and a bottom body half 308. The left end 310 (as viewed in FIG. 32) is angled to mate with an identical roof panel at the roof top (i.e., the enclosure apex.) The right end 312 (FIG. 32) is configured to pass over a sidewall 56 (i.e., FIG. 4) and form eaves. End 312 includes a pair of spaced apart notches 313, 315 (FIG. 32) that mate with the stepped, upper end of a representative wall panel 319 that has been drawn with phantom lines in FIG. 32. Referencing FIGS. 4 and 32 the notch 315 is centered within a cornice portion 314 of the modular roof panel, that is positioned proximate the exterior soffit 316 (FIG. 4).

Figure 32:
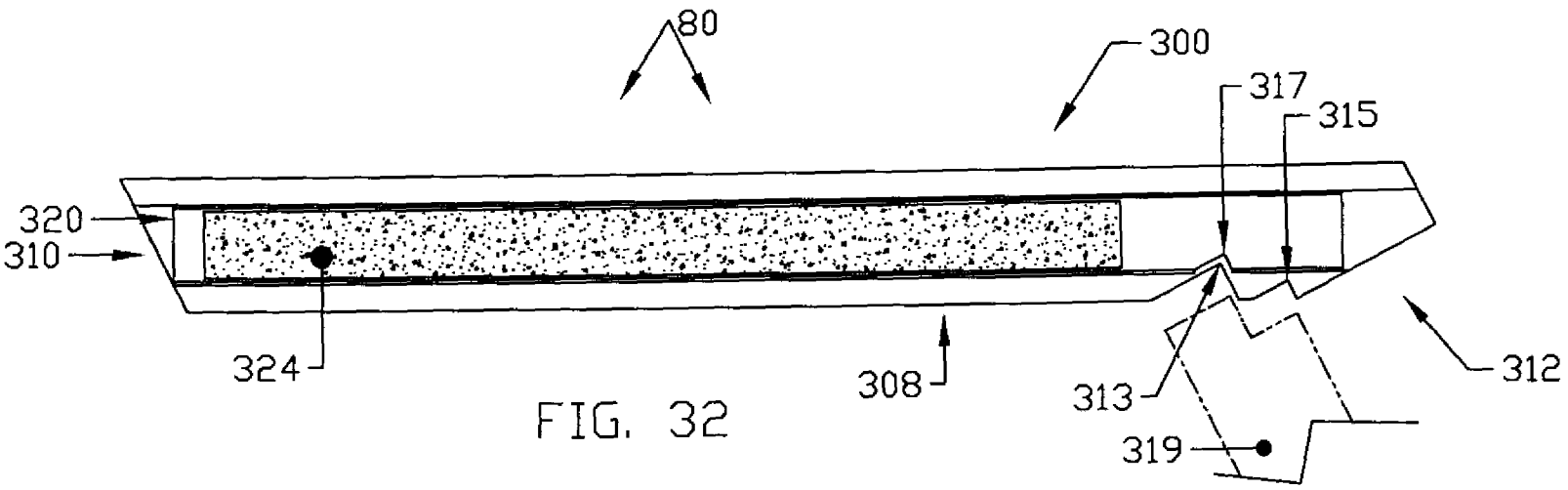
FIG. 32 is a side elevational view taken generally along line 32-32 of FIG. 30.
Figure 33:
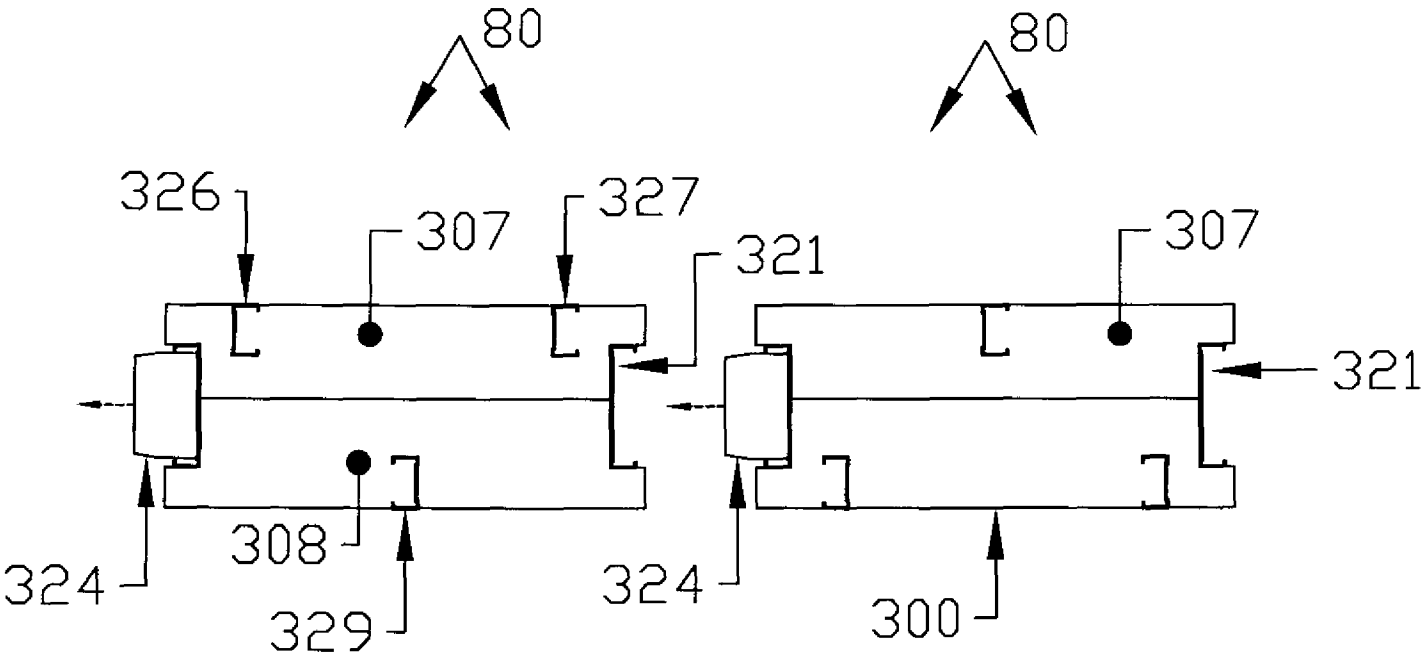
FIG. 33 is a fragmentary, exploded end view showing a portion of a roof assembled from multiple roof panels of FIG. 30; and, FIG. 34 is a diagrammatic and pictorial view showing basic modular plastic components, and the preferred prestressing strap system.
Figure 34:
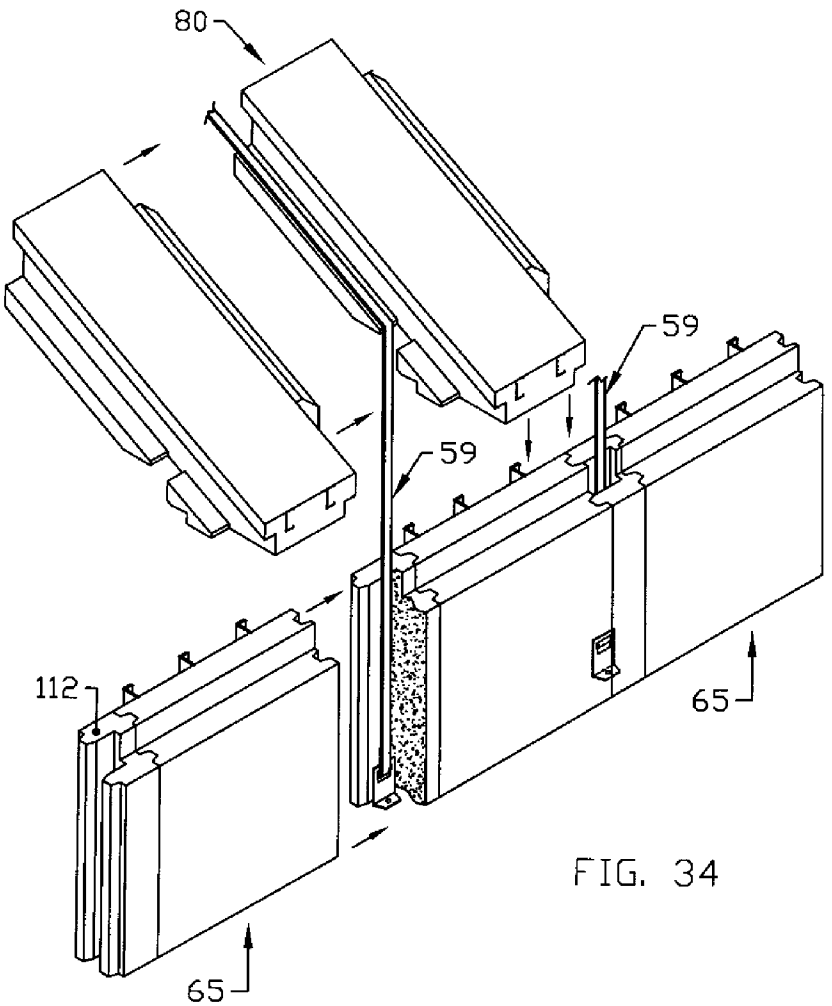

Each roof panel 80 is braced by a pair of major channel struts 320, 322 (i.e., FIG. 30) for reinforcement. These elongated, and parallel struts 320, 322 are received within receptive side channels 321 formed in the sides of the EPS body 300 (FIG. 30). Preferably the metallic channel reinforcement strut 320 has a small clearance notch 317 proximate the EPS notch 313 (FIG. 32). Notch 317 is cut through the flange portion of the reinforcement channel strut 320 to pass the strapping 59 used for pretensioning. Each strut 320, 322 receives an elongated EPS expansion joint coupling 324 (FIGS. 30, 32) that is glued into position and secures bordering roof panels along their edges. For reinforcement the upper body half 307 (FIGS. 4, 31) receives a pair of elongated, metallic channel struts 326 and 327. There is a similar lower reinforcement strut 329 (FIG. 30) disposed in the bottom half 308 of the EPS roof panel body 300 (FIG. 33) at a position below and substantially between struts 326 and 327.

A uniquely routed strapping system is used to pretension the enclosure 50. Strapping is seen in FIGS. 3, 3A, 4-5 and 34. As viewed in FIG. 34 there are multiple spaced apart straps 59 extending from the slab 53 upwardly through walls and over the roof panels at an inclination. As best seen in FIG. 3, a typical strap 59 begins at one wall, extending upwardly through the wall and over the roof, passing over the apex and down the other side. Noting FIG. 5, spaced apart anchor bolts 57 are seated within the slab 52 at properly spaced apart intervals. As seen in FIG. 4, a strap 59 may be routed through a groove 120 within the end of an adaptor 112 (through space 121 of FIG. 7), and routed upwardly towards the lower notched region of the roof panel 80. Noting FIG. 7, each panel end adaptor 112 has a deep groove 120 between its end tongues 118, which forms void 121 in FIG. 4. (Grooves other than adaptor grooves, in other panels for example, may rout straps where necessary.) Each strap 59 extends upwardly as in FIGS. 4 and 34, and then when engaging a roof panel, turns angularly and runs through sides of the roof panels, within the major channel 320 on the roof panel sides. Noting FIG. 3A, when a strap 59 passes over the roof apex region 82, it is seated within an angular, metallic guide 309 placed within the side channels 321 of the roof panels 80. The guide 309 is made of channel metal, with a central notch 311 cut in the middle to facilitate bending. Strap tensioning can be accomplished though techniques well known in the art.

The configured roof panel ends 312 and tops of the sidewalls 56 intersect as is detailed in FIG. 4. In FIG. 32 there is seen a notch 317 that cuts through the side flange portion of the channel strut reinforcement 320 that braces the sides of the roof panels 80 (i.e., FIG. 30). As best seen in FIG. 4, each strap 59 passes through the break (i.e., notch 317) in the reinforcement channel strut 320 and runs along the flange edge of the channel strut 320. Strapping can continue over the roof apex, down a channel strut in roof panels on the other side, and down through another groove (i.e., groove 120 on adaptor 112) on a panel in the opposite side wall, and may terminate at another anchor bolt 57 (FIG. 5). The straps 59 thus nondestructively distribute force along the sides of the channel struts 320 in the roof panels, and they apply compressive force to the wall panel tops.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. An energy-efficient, modular enclosure adapted to be assembled upon a supporting surface from prefabricated plastic parts, the enclosure comprising:

at least one sidewall, each said at least one sidewall comprising a plurality of wall panels comprising plastic foam bodies, the wall panels adapted to be coupled to other wall panels to form said at least one sidewall;

at least one gabled end wall intersecting said at least one sidewall, the said at least one gabled end wall comprising a plurality of gable panels comprising plastic foam bodies, the gable panels adapted to be coupled to each other to form said at least one gable end wall;

plastic foam adaptor means for enabling said at least one sidewall panel to interfit with another said at least one sidewall, the adaptor means forming routing voids when coupled to another said at least one sidewall panel;

a roof formed of multiple roof panels, the roof panels adapted to be fitted together over said enclosure in engagement with said at least one sidewall and said at least one gabled end wall to form said roof, said roof panels comprising sides with reinforcing channels;

means for securing said enclosure to said supporting surface, said means for securing said enclosure comprising anchors seated within said supporting surface, and an elongated strap extending between said anchors that traverses said roof, the strap extending upwardly through and within said routing void and through roof panel reinforcing channels; and, wherein the wall panels comprise major and minor reinforcement struts associated with their plastic bodies, wherein the major reinforcement struts have an offset portion facing interiorly of the enclosure that is spaced apart from the surface of the wall panels in which the major reinforcement struts are disposed for forming a mounting for interior walls, accessories or finishing, said major reinforcement struts comprising an integral portion disposed within said plastic foam bodies, and wherein the major and minor reinforcement struts are isolated from one another and positioned to avoid the establishment of conductive thermal pathways through said plastic foam bodies.

2. The modular enclosure as defined in claim 1 wherein the plastic foam adaptor means and wall panels comprise tongues and grooves, wherein said tongues and grooves of said plastic foam adaptor means form a complementary fit with said tongues and grooves of the wall panels and wherein the plastic foam adaptor means includes at least one routing groove adapted to form said routing void.

3. The modular enclosure as defined in claim 1 wherein said at least one sidewall panel comprises at least one door panel comprising a plastic foam body, the door panel adapted to be coupled to said wall panels to form doors within said at least one sidewall.

4. The modular enclosure as defined in claim 1 wherein said at least one sidewall panel comprises at least one window panel comprising a plastic foam body that forms windows within said at least one sidewall, the wall panels adapted to be coupled to said window panel.

5. The modular enclosure as defined in claim 1 wherein:

said enclosure comprises an upper apex region;

said enclosure comprises at least one support column that extends vertically, upwardly from the supporting surface to the upper apex region;

a horizontally oriented beam extends through said upper apex region;

said support column contacts said horizontally oriented beam; and, the horizontally oriented beam contacts and elevates an elongated, horizontally oriented gusset that extends through the upper apex region to spread out the forces or pressures exerted upon or by the roof.

6. An energy-efficient, modular enclosure adapted to be assembled upon a supporting surface from prefabricated plastic parts, the enclosure comprising:

at least one sidewall comprising a plurality of wall panels, said wall panels comprising plastic foam bodies, the wall panels coupled together to form said at least one sidewall;

at least one end wall intersecting said at least one sidewall, said at least one end wall comprising a plurality of gable panels, each gable panel comprising plastic foam bodies, the gable panels coupled together to form said at least one end wall;

means disposed between intersecting at least one sidewall and at least one end wall for joining the at least one sidewall and at least one end wall at a corner;

a roof formed of multiple roof panels, the roof panels adapted to be fitted together over said enclosure in engagement with said at least one sidewall and said at least one end wall to form said roof;

wherein the at least one sidewall panel comprises strut means for reinforcement, said strut means comprising elongated major reinforcement struts and elongated minor reinforcement struts generally parallel with and spaced apart from said major reinforcement struts, said major reinforcement struts comprising a portion disposed within and integral with said plastic foam bodies, offset portions spaced apart from the plastic foam bodies for mounting interior walls, accessories or finishing, and wherein the major and minor reinforcement struts are isolated from one another to avoid the establishment of conductive thermal pathways through said plastic foam bodies;

wherein said at least one sidewall comprises at least one window panel that forms at least one window within said at least one sidewall, the wall panels adapted to be coupled to said at least one window panel;

wherein the enclosure comprises at least one door panel in at least one sidewall, the at least one door panel adapted to be coupled to said wall panels or said at least one window panel to form doors for said enclosure;

a plurality of plastic foam adaptors for coupling wall panels together; each adaptor comprising a routing void;

anchors seated within the supporting surface; and, at least one tensioning strap connected to and extending between said anchors that extends upwardly through said at least one sidewall, passing through a routing void defined in at least one adaptor, and wherein, for at least a portion of the strap length, said strap seats within a reinforcement channel secured within sides of said roof panels, whereby said wall panels are put in compression, and said roof panels are urged towards said wall panels.

7. The modular enclosure as defined in claim 6 wherein said means for joining the at least one sidewall and at least one end wall comprises at least one plastic foam corner junction that interconnects with a at least one sidewall and an at least one end wall.

8. An energy-efficient, modular enclosure adapted to be assembled upon a supporting surface from prefabricated plastic parts, the enclosure comprising:

at least one stepped sidewall comprising a plurality of wall panels comprising plastic foam bodies, the wall panels adapted to be coupled to one another to form said at least one stepped sidewall, each wall panel comprising at least one strap routing void;

at least one door panel comprising a plastic foam body, the door panel adapted to be coupled to wall panels to form doors within said enclosure;

at least one window panel comprising a plastic foam body, the window panel adapted to be coupled to wall panels or at least one door panel to form windows within said enclosure;

at least one gabled end wall intersecting said at least one stepped sidewall, the at least one gabled end wall comprising a plurality of gable panels comprising plastic foam bodies, the gable panels adapted to be coupled to each other to form said at least one gabled end wall;

at least one corner junction adapted to be fitted between intersecting at least one stepped sidewall and at least one gabled end wall to form comers of said enclosure;

wherein the wall panels, the at least one window panel and the at least one door panel comprise means for longitudinally reinforcing them, said reinforcing means comprising major and minor reinforcement struts that are disposed in parallel and spaced apart relation within the plastic foam bodies of the wall panels, the at least one window panel, and the at least one door panel, and wherein the major reinforcement struts have an offset portion facing interiorly of the enclosure that is spaced apart from the plastic surface of the at least one window panel, the at least one door panel, or wall panels in which the major reinforcement strut is disposed for forming a mounting for interior walls, accessories or finishing, and wherein the major and minor reinforcement struts are isolated from one another and positioned to avoid the establishment of conductive thermal pathways through said foam bodies;

an upper apex region;

a roof formed of multiple roof panels, the roof panels adapted to be fitted together over said enclosure and configured to engage and mate with said at least one stepped sidewall and said at least one end wall to form said roof, said roof panels extending angularly, upwardly from the top of the at least one stepped sidewall to the apex region;

at least one tensioning strap that extends upwardly through said at least one stepped sidewall and traverses said upper apex region, the straps passing through at least one routing void defined in the at least one stepped sidewall; and, wherein, for at least a portion of each strap length, the strap seats within a reinforcement channel secured within sides of said roof panels, whereby said wall panels are put in compression, and said roof panels are urged towards said wall panels.

9. The modular enclosure as defined in claim 8 wherein:

the enclosure comprises at least one support column that extends vertically, upwardly from the supporting surface to the upper apex region;

a horizontally oriented beam extending through said upper apex region and is supported by said column; and, said beam elevates an elongated, gusset that extends horizontally through the apex region to spread out pressures exerted upon or by the roof.

10. An energy-efficient, modular enclosure adapted to be assembled upon a supporting surface from prefabricated plastic parts, the enclosure comprising:

at least one stepped sidewall comprising a plurality of wall panels comprising plastic foam bodies, the wall panels adapted to be coupled to one another to form said at least one stepped sidewall;

at least one gabled end wall intersecting said at least one sidewall, the at least one gabled end wall comprising a plurality of gable panels comprising plastic foam bodies, the gable panels adapted to be coupled to each other to form said at least one gabled end wall and the gable panels varying in height and having angled tops coextensive with a roof line;

tongue and groove means for enabling wall panels to interfit with one another wall panels to form said at least one stepped sidewall, said tongue and groove means establishing at least one strap routing void in said at least one sidewall between adjacent wall panels;

at least one corner junction adapted to be fitted between intersecting at least one of said sidewall and end wall to form comers of said enclosure;

a roof formed of multiple roof panels, the roof panels adapted to be fitted together over said enclosure in engagement with said at least one stepped sidewall and said at least one end wall to form said roof, the roof panels having notched portions to mate with the at least one stepped sidewall;

at least one tensioning strap that extends upwardly through said at least one sidewall, the strap passing through said routing void;

wherein, for at least a portion of length of each strap, said strap seats within a reinforcement channel secured within said roof panels, whereby said wall panels are put in compression, and said roof panels are urged towards said wall panels;

at least one support column that extends vertically, upwardly from the supporting surface to the an apex region; and, said at least one support column elevates an elongated, horizontally oriented gusset that extends horizontally through the apex region to spread out the forces or pressures exerted upon or by the roof.

11. The modular enclosure as defined in claim 10 wherein said gusset comprises a flat, center portion supported by said at least one support column and integral, spaced-apart, inclined wings that abut opposite, inclined surfaces of the roof.

* * * * *